US006140037A

United States Patent [19]

Katoh et al.

[11] Patent Number: 6,140,037

[45] **Date of Patent: *Oct. 31, 2000**

[54] PHOTOTHERMOGRAPHIC MATERIAL AND METHOD FOR MAKING

[75] Inventors: Kazunobu Katoh; Akira Hatakeyama, both of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/843,714

[22] Filed: Apr. 17, 1997

[30] Foreign Application Priority Data

| | | | |
|---|---|---|---|
| Apr. 26, 1996 | [JP] | Japan | 8-130841 |
| Aug. 16, 1996 | [JP] | Japan | 8-234732 |
| Nov. 13, 1996 | [JP] | Japan | 8-316986 |
| Dec. 25, 1996 | [JP] | Japan | 8-355977 |

[51] Int. Cl.[7] ..... G03C 1/498

[52] U.S. Cl. ..... 430/619; 430/531; 430/533

[58] Field of Search ..... 430/619, 531, 430/533, 534, 536

[56] References Cited

U.S. PATENT DOCUMENTS

| | | | |
|---|---|---|---|
| 3,801,321 | 4/1974 | Evans et al. . | |
| 4,120,728 | 10/1978 | Ikenoue et al. . | |
| 4,258,129 | 3/1981 | Ikenoue et al. . | |
| 4,264,725 | 4/1981 | Reeves . | |
| 4,529,689 | 7/1985 | Lee . | |
| 4,987,061 | 1/1991 | Helling et al. . | |
| 5,424,182 | 6/1995 | Marginean, Sr. et al. . | |
| 5,677,121 | 10/1997 | Tsuzuki . | |
| 5,698,380 | 12/1997 | Toya | 430/363 |

FOREIGN PATENT DOCUMENTS

| | | |
|---|---|---|
| 627658 A1 | 12/1994 | European Pat. Off. . |
| 95201968 | 7/1995 | European Pat. Off. . |
| 752616 A1 | 1/1997 | European Pat. Off. . |
| 58-28737A | 2/1983 | Japan . |
| 2018453A | 10/1979 | United Kingdom . |
| WO97 04355 | 2/1997 | WIPO . |
| WO97 04356 | 2/1997 | WIPO . |

OTHER PUBLICATIONS

The Condensed Chemical Dictionary, Tenth Edition, Revised by Gessner G. Hawley, p. 1016, 1981.
Article on high polymer latex adhesives (Document 1).
Article on polymer latex (Document 2).
Article on lacstar (Document 3).

*Primary Examiner*—Thorl Chea
*Attorney, Agent, or Firm*—Birch, Stewart, Kolasch & Birch, LLP

[57] ABSTRACT

A photothermographic material exhibiting satisfactory photographic properties can be prepared using an aqueous dispersion of components. A photosensitive layer is formed by dispersing a binder and silver halide in an aqueous solvent containing at least 30 wt % of water to form an aqueous dispersion, coating the aqueous dispersion onto a support, and drying the coating. The binder is a polymer having an equilibrium moisture content of 0.1–2 wt % at 25° C. and RH 60% or a thermoplastic resin. The binder is preferably based on a styrene-butadiene copolymer. Fog is suppressed even when the material is stored in a humid atmosphere.

8 Claims, No Drawings

PHOTOTHERMOGRAPHIC MATERIAL AND METHOD FOR MAKING

BACKGROUND OF THE INVENTION

1. Field of the Invention

This invention relates to a photothermographic material and a method for preparing the same.

2. Prior Art

Photothermographic materials which are processed by a photothermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic materials generally contain a reducible silver source (e.g., organic silver salt), a catalytic amount of a photocatalyst (e.g., silver halide), a toner for controlling the tonality of silver, and a reducing agent, typically dispersed in a binder matrix. Photothermographic materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, eventually forming an image.

Such photothermographic materials have been used as microphotographic and radiographic photosensitive materials.

With the recent advance of lasers and light-emitting diodes, image output devices such as laser imagers and laser image setters find widespread use. They are used for recording medical images and printing plate images. There is a strong desire to have a photosensitive material which has so high sensitivity and maximum density and is so easily dry processable that it may comply with such output devices.

The above-mentioned photothermographic materials are quite simple in that images can be formed merely by heating after exposure, and has advantages that no processing agents in liquid or powder form are required, neither peeling nor attaching step is required, and no waste is yielded. Because of these advantages, the photothermographic materials are regarded potentially suitable for use in laser output devices.

Prior art photothermographic materials are generally prepared by dissolving a binder in an organic solvent, dispersing an organic silver salt and silver halide in the binder, adding a solution of a reducing agent and toner in a similar organic solvent to the dispersion, and applying the resultant coating solution to a film support, followed by drying. This process has several problems of (1) environmental pollution that the organic solvent is evaporated in the coating and drying steps to diffuse into the air, (2) low productivity that the coating rate is low and concurrent coating of multiple layers is difficult and (3) hazard including flammability and explosion.

To solve these problems, we attempted to design a photothermographic material as an aqueous system using a water-soluble binder, but failed to provide satisfactory photographic performance.

For example, JP-A 52626/1974 and 116144/1978 disclose the use of gelatin as a binder. JP-A 151138/19775 discloses the use of polyvinyl alcohol as a binder. JP-A 61747/1985 discloses the combined use of gelatin and polyvinyl alcohol. JP-A 28737/1983 discloses a photosensitive layer containing water-soluble polyvinyl acetal as a binder. The use of these binders leads to environmental and economical benefits because a photosensitive layer can be formed using a coating solution in a water solvent.

Photosensitive materials using gelatin, polyvinyl alcohol, polyacetal and other water-soluble polymers as the binder, however, have the drawback that fog is increased when they are stored in a humid atmosphere. It is thus desired to have a technique capable of forming a photosensitive layer from an aqueous system which is advantageous from environmental and economical aspects and suppressing fog upon storage in a humid atmosphere.

SUMMARY OF THE INVENTION

A primary object of the present invention is to provide a novel and improved photothermographic material in which fog is suppressed even when the material is used or stored in a humid atmosphere.

Another object of the present invention is to provide a novel and improved method for preparing a photothermographic material using an aqueous coating solution so that the resulting photosensitive material may exert satisfactory photographic performance.

A further object of the present invention is to provide a novel and improved photothermographic material having a photosensitive layer which can be formed by coating an aqueous coating solution which is advantageous in environmental protection and cost, the photosensitive material being able to produce an image of good color tone with less fog even after storage in a humid atmosphere.

In a first aspect, the present invention provides a photothermographic material comprising a support, a photosensitive layer disposed on at least one surface of the support and containing a photosensitive silver halide and a binder, and a non-photosensitive silver salt and a reducing agent therefor. According to the invention, the binder is mainly composed of a primary binder which is a polymer having an equilibrium moisture content of up to 2% by weight at 25° C. and RH 60% or a thermoplastic resin. The photosensitive layer is formed by applying a coating solution dispersed in an aqueous solvent containing at least 30% by weight of water onto the support and drying the coating.

In one preferred embodiment, the aqueous solvent contains at least 50%, more preferably at least 70% by weight of water.

Preferably, the non-photosensitive silver salt is an organic silver salt and is contained in the photosensitive layer.

Preferably, the reducing agent is contained in the photosensitive layer or a layer other than the photosensitive layer.

Preferably, the primary binder constitutes at least 70% by weight of the binder.

Preferably, the primary binder is a polymer having an equilibrium moisture content of up to 2%, more preferably 0.1 to 1.5%, most preferably 0.2 to 1% by weight at 25° C. and RH 60%. The polymer is preferably selected from the group consisting of a polyurethane, polyester, vinyl chloride resin, vinylidene chloride resin, rubbery resin, polyvinyl acetate, polyvinyl acetal, polyolefin, styrene-butadiene copolymer, acryl resin and a mixture thereof.

Where the primary binder is a thermoplastic resin, the thermoplastic resin is selected from the group consisting of a polyvinyl butyral, polyurethane, styrene-butadiene copolymer, acryl resin and a mixture thereof.

Preferably the polymer or thermoplastic resin contains at least 70% by weight of a styrene-butadiene copolymer.

In a second aspect, the present invention provides a method for preparing a photothermographic material comprising a support, a photosensitive layer disposed on at least one surface of the support and containing a photosensitive silver halide, and a non-photosensitive silver salt and a reducing agent therefor, the method comprising the steps of:

dispersing a primary binder and the silver halide in an aqueous solvent containing at least 30% by weight of water to form an aqueous dispersion, the primary binder being a polymer having an equilibrium moisture content of up to 2% by weight at 25° C. and RH 60% or a thermoplastic resin, coating the aqueous dispersion onto a support, and drying the coating to form the photosensitive layer.

In one preferred embodiment, the method may further include the step of adding the non-photosensitive silver salt to the aqueous dispersion. The method may further include the step of adding a water dispersion of the reducing agent to the aqueous dispersion. The method may further include the step of containing the reducing agent in a layer other than the photosensitive layer. The method may further include the steps of coating at least one non-photosensitive layer on the same surface of the support as the photosensitive layer, and concurrently drying the photosensitive layer and the non-photosensitive layer.

DESCRIPTION OF THE PREFERRED EMBODIMENTS

Photosensitive Layer

The photosensitive layer of the photothermographic material according to the invention is described. Among layers of the photothermographic material according to the invention, the photosensitive layer designates a layer containing silver halide. In the photothermographic material according to the invention, there may be two or more photosensitive layers, at least one of which is a photosensitive layer wherein a polymer latex or thermoplastic polymer dispersed in water constitutes more than 50% by weight of an entire binder. This photosensitive layer is thus referred to as the photosensitive layer of the invention.

The "polymer latex" is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of 1 to 50,000 nm, more preferably 5 to 1,000 nm. No particular limit is imposed on the particle size distribution of dispersed particles, and the dispersion may have either a wide particle size distribution or a monodisperse particle size distribution.

The polymer latex used herein may be either a latex of the conventional uniform structure or a latex of the so-called core/shell type. In the latter case, better results are sometimes obtained when the core and the shell have different glass transition temperatures.

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the polymer latex according to the invention include acryl resins, vinyl acetate resins, polyester resins, polyurethane resins, rubbery resins, vinyl chloride resins, vinylidene chloride resins, polyolefin resins, and copolymers thereof.

Illustrative examples of the polymer latex which can be used as the binder of the photosensitive layer of the invention include latices of methyl methacrylate/ethyl acrylate/methacrylic acid copolymers, latices of methyl methacrylate/2-ethylhexyl acrylate/styrene/acrylic acid copolymers, latices of styrene/butadiene/acrylic acid copolymers, latices of styrene/butadiene/divinyl benzene/methacrylic acid copolymers, latices of methyl methacrylate/vinyl chloride/acrylic acid copolymers, and latices of vinylidene chloride/ethyl acrylate/acrylonitrile/methacrylic acid copolymers.

These polymers are commercially available. Exemplary acryl resins are Sebian A-4635, 46583 and 4601 (Daicell Chemical Industry K.K.) and Nipol LX811, 814, 820, 821 and 857 (Nippon Zeon K.K.). Exemplary polyester resins are FINETEX ES650, 611, 675, and 850 (Dai-Nihon Ink Chemical K.K.) and WD-size and WMS (Eastman Chemical Products, Inc.). Exemplary polyurethane resins are HYDRAN AP10, 20, 30 and 40 (Dai-Nihon Ink Chemical K.K.). Exemplary rubbery resins are LACSTAR 7310K, 3307B, 4700H and 7132C (Dai-Nihon Ink Chemical K.K.) and Nipol LX416, 410, 438C and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.).

The thermoplastic polymer which can be used herein is a resin which can be plasticized at the temperature at which the photosensitive layer of the invention is dried after coating. The drying temperature of the photosensitive layer of the invention is desirably from room temperature to about 100° C. Therefore, polymers which can be plasticized in this temperature range are preferred.

Illustrative examples of the thermoplastic polymer include cellulose acetate butyrate, cellulose acetate propionate, polyvinyl formal, polyvinyl butyral (PVB), polyvinyl acetate, styrene-butadiene copolymers, polyurethanes, polyesters, and acryl resins. In the practice of the invention, these thermoplastic polymers are used in the form of a water dispersion.

An aqueous dispersion of the thermoplastic resin may be formed by any well-known dispersion method. For example, an aqueous dispersion is prepared by adding 5 to 80% by weight of a plasticizer (e.g., saturated or unsaturated higher fatty acid ester) to resin powder, adding 1 to 30% by weight of an alkylarylsulfonate as a dispersant, heating the mixture at a temperature above Tg for dissolving solids, agitating the solution in an emulsifying/dispersing machine while gradually adding water, thereby once forming a dispersion of water-in-resin type, and further gradually adding water to induce phase transition, thereby forming a dispersion of resin-in-water type. Preferably the dispersion has as small a particle size as possible. The particle size can be controlled by adjusting the viscosity of a resin solution phase and the shearing force of the dispersing machine. Preferably the dispersion is comminuted to a mean particle size of up to 1 $\mu$m, typically 0.01 $\mu$m to 1 $\mu$m.

There may be used a commercially available water dispersion, for example, an aqueous dispersion of polyvinyl butyral available under the trade name of Butvar Dispersion FP or BR from Monsanto Co. A vinyl butyral homopolymer or copolymer should preferably have a weight average molecular weight Mw of about 1,000 to about 100,000. The copolymer should preferably have a vinyl butyral content of at least 30% by weight.

Other commercially available water dispersions include water dispersions of anionic polyurethane available under the trade name of Adeka Bon-Tighter HUX-350, 232, 551, 290H, and 401 from Asahi Denka Kogyo K.K., water dispersions of aqueous vinyl urethane available under the trade name of KR-120, KR-134, KC-1, KR-2060, and KR-173 from Koyo Sangyo K.K., and water dispersions of aqueous vinyl urethane available under the trade name of Maruka UV Bond #10, #31 and #50 from Maruban Company. A urethane homopolymer or copolymer should preferably have a weight average molecular weight Mw of about 1,000 to about 100,000. The copolymer should preferably have a urethane content of at least 30% by weight.

Styrene-butadiene copolymers are commercially available as Sumitomo SBR latex from Sumitomo Chemical K.K., JSR latex from Japan Synthetic Rubber K.K, and Nipol latex from Nippon Zeon K.K. under the standardized trade number of #1500, #1502, #1507, #1712, and #1778.

The styrene-butadiene copolymer latex should preferably have a styrene to butadiene weight ratio of from 10/90 to 90/10, more preferably from 20/80 to 90/10, most preferably from 20/80 to 60/40. A copolymer known as high-styrene latex having a styrene/butadiene ratio of from 60/40 to 90/10 is preferably used in admixture with a low styrene content latex having a styrene/butadiene ratio of from 10/90 to 30/70 because the photosensitive layer is improved in mar resistance and physical strength. The mixing ratio (weight) is preferably from 20/80 to 80/20.

High-styrene latex is commercially available in the trade name of JSR 0051 and 0061 from Japan Synthetic Rubber K.K. and Nipol 2001, 2057 and 2007 from Nippon Zeon K.K. Low styrene content latexes are commercially available ones other than the examples of high-styrene latex, for example, JSR #1500, #1502, #1507, #1712, and #1778.

Acrylic latex generally known as acryl rubber is commercially available in the trade name of Nipol AR31 and AR32 and Hycar 4021 from Nippon Zeon K.K.

The polymer latex or thermoplastic polymer which can be used in the present invention may be linear, branched or crosslinked. Further the polymer may be either a homopolymer resulting from polymerization of a single monomer or a copolymer resulting from polymerization of two or more monomers. The copolymer may be either a random copolymer or a block copolymer. The polymer preferably has a number average molecular weight of about 5,000 to 1,000,000, more preferably about 10,000 to 100,000. A polymer with a lower molecular weight would provide a photosensitive layer with insufficient mechanical strength whereas a polymer with a higher molecular weight is unlikely to form a film.

The polymer of the polymer latex used herein should have an equilibrium moisture content of up to 2% by weight, preferably 0.1 to 1.5% by weight, more preferably 0.2 to 1% by weight at 25° C. and RH 60%. With respect to the definition and measurement of an equilibrium moisture content, reference is made to Kobunshi Gakkai Ed., "Polymer Engineering Series 14—Polymeric Material Tests," Chijin Shokan K.K.

The polymer latices and water dispersions of the thermoplastic polymers may be used alone or in admixture of two or more.

In the photosensitive layer of the invention, the polymer latex or water dispersion of thermoplastic polymer preferably constitutes at least 50%, especially at least 70% by weight of an entire binder. If desired, a hydrophilic polymer is added in an amount of less than 50%, preferably less than 30% by weight of the entire binder. The hydrophilic polymer may be selected from gelatin, polyvinyl alcohol (PVA), methyl cellulose, hydroxypropyl cellulose, carboxymethyl cellulose, and hydroxypropylmethyl cellulose.

The photosensitive layer of the invention is formed by applying an aqueous coating solution to form a coating and drying the coating. The "aqueous" system indicates that water constitutes at least 30% by weight of the solvent or dispersing medium of the coating solution. The remainder of the solvent or dispersing medium may be a water-miscible organic solvent such as methyl alcohol, ethyl alcohol, isopropyl alcohol, methyl cellosolve, ethyl cellosolve, dimethylformamide (DMF), and ethyl acetate. Exemplary compositions of the solvent include water/methanol=90/10, water/methanol=70/30, water/ethanol=90/10, water/isopropanol=90/10, water/DMF=95/5, water/methanol/DMF=80/15/5, water/methanol/DMF=90/5/5 (mix ratios are by weight).

Preferably the photosensitive layer of the invention contains a binder in a total coverage of 0.2 to 30 g/m$^2$, more preferably 1 to 15 g/m$^2$.

In addition to the silver halide and the binder, an organic silver salt, reducing agent therefor, toner, antifoggant, matte agent, lubricant, crosslinking agent, surfactant, dyestuff and other suitable additives may be added to the photosensitive layer of the invention.

The lubricant used herein is selected from compounds well known in the art, for example, silicon compounds and paraffin. The amount of lubricant added varies with the layer construction and thickness of the photothermographic material and the purpose of addition although a coverage of about 10 to 500 mg/m$^2$, especially about 20 to 300 mg/m$^2$ is preferred.

Non-photosensitive Layer

In addition to the photosensitive layer, the photothermographic material of the invention may include a non-photosensitive layer. Any desired binder may be used in the non-photosensitive layer. The binder may be selected from various polymers, for example, gelatin, polyvinyl alcohol, casein, agar, gum arabic, hydroxyethyl cellulose, cellulose acetate, cellulose acetate butyrate, polyvinyl chloride, polymethacrylic acid, polyvinyl chloride, and polyvinyl acetate. Among these, hydrophilic polymers are preferred, with gelatin being most preferred. The gelatin may be any of lime-treated gelatin, acid-treated gelatin and otherwise treated gelatin. Gelatin derivatives are also useful. A polymer latex of ethyl acrylate, for example, may be added to the hydrophilic polymer as the binder of the non-photosensitive layer.

The non-photosensitive layer preferably has a thickness of 0.1 to 10 $\mu$m, more preferably 0.5 to 5 $\mu$m.

The non-photosensitive layer is formed by applying an aqueous coating solution (as defined for the photosensitive layer) to form a coating and drying the coating.

In the non-photosensitive layer, an organic silver salt, reducing agent therefor, toner, antifoggant, matte agent, dyestuff, lubricant, crosslinking agent, surfactant, and other suitable additives may be added if desired.

Back Layer

In addition to the photosensitive layer, the photothermographic material of the invention may include a back layer on the surface of the support opposite to the photosensitive layer-bearing surface. Any desired binder may be used in the back layer and a choice may be made among the polymers described in conjunction with the photosensitive and non-photosensitive layers. The polymer latex and water dispersion of thermoplastic polymer described in conjunction with the photosensitive layer are preferred as the binder, with a polymer having an equilibrium moisture content of up to 2% by weight at 25° C. and RH 60% being especially preferred. The back layer is preferably formed by applying an aqueous coating solution and drying the coating.

Preferably the back layer should have a maximum absorbance of 0.3 to 2, especially 0.5 to 2 in the desired wavelength range. Further preferably the back layer has an absorbance of 0.001 to less than 0.5 in the visible region after processing. Also preferably the back layer has an optical density of 0.001 to less than 0.3.

The back layer preferably has a thickness of 0.1 to 20 $\mu$m, more preferably 0.5 to 10 $\mu$m. With respect to a degree of matte, the back surface preferably has a Bekk smoothness of 10 to 250 seconds, more preferably 50 to 180 seconds.

The photothermographic material of the invention may further include a protective layer on the back layer. Any desired binder may be used in the back surface protective layer. A choice may be made among the polymers described in conjunction with the non-photosensitive layer, with hydrophilic polymers being preferred. The back surface protective layer is preferably formed by applying an aqueous coating solution and drying the coating.

If desired, a matte agent, dyestuff, lubricant, surfactant and other suitable additives may be added to the back surface protective layer.

The back surface protective layer preferably has a thickness of 0.1 to 10 $\mu$m, more preferably 0.5 to 5 $\mu$m.

Components

Some of components contained in photosensitive, non-photosensitive and other layers of the photothermographic material of the invention have been described above. The remaining components are described below.

According to the invention, chemically sensitized silver halide is preferably used as a photosensitive silver salt. A method for forming a photosensitive silver salt is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is preferably up to 0.20 $\mu$m, more preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the plane indices (Miller indices) of an outer surface of silver halide grains. Preferably silver halide grains have a high proportion of {100} plane featuring high spectral sensitization efficiency upon adsorption of a spectral sensitizing dye. The proportion of {100} plane is preferably at least 50%, more preferably at least 65%, most preferably at least 80%. Note that the proportion of Miller index {100} plane can be determined by the method described in T. Tani, J. Imaging Sci., 29, 165 (1985), utilizing the adsorption dependency of {111} plane and {100} plane upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Especially preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. The metal complex is preferably contained in an amount of 1 nmol to 10 mmol, more preferably 10 nmol to 100 $\mu$mol per mol of silver. Illustrative metal complex structures are those described in JP-A 225449/1995. Preferred among cobalt and iron complexes are hexacyano metal complexes. Illustrative, non-limiting examples include a ferricyanate ion, ferrocyanate ion, and hexacyanocobaltate ion. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, palladium, and iridium and a reduction sensitization method. In the sulfur, selenium, and tellurium sensitization methods, any of compounds well known for the purpose may be used. For example, sulfur sensitizing agents include sulfur-containing compounds capable of reacting with active gelatin and silver, such as thiosulfates, thioureas, mercapto compounds, and rhodanines. Selenium sensitizing agents include unstable selenium compounds and non-unstable selenium compounds. Exemplary unstable selenium compounds are described in JP-B 15748/1969 and 13489/1968, Japanese Patent Application Nos. 130976/1990 and 229300/1990. Exemplary non-unstable selenium compounds are described in JP-B 4553/1971, 34492/1977, and 34491/1977. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocyclics, tellurocarbonyl compounds, inorganic tellurium compounds, and colloidal tellurium.

The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061.

Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

The chemical sensitization methods mentioned above may be used alone or in combination. It is preferred to combine at least one of the sulfur, selenium and tellurium sensitization methods with another sensitization method, especially the sulfur sensitization method with another sensitization method.

In the practice of the invention, photosensitive silver halide is preferably used in an amount of 0.01 mol to 0.5 mol, more preferably 0.02 mol to 0.3 mol, most preferably 0.03 mol to 0.25 mol per mol of the non-photosensitive silver salt, typically organic silver salt.

With respect to a method and conditions of mixing the separately prepared photosensitive silver halide and organic silver salt, there may be used a method of mixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

The reducing agent for the non-photosensitive silver salt, typically organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly higher amount of about 2 to 15% by weight of that layer.

For photothermographic materials using organic silver salts, a wide range of reducing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1-1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbin stearate; aldehydes and ketones such as benzil and diacetyl; 3-pyrazolidones and certain indane-1,3-diones.

Especially preferred reducing agents used herein are those compounds of the following formulae (R-I), (R-II), (R-III), and (R-IV).

(R-I)

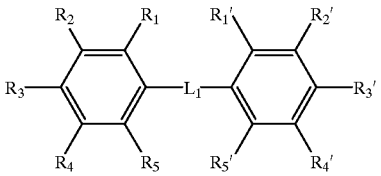

(R-II)

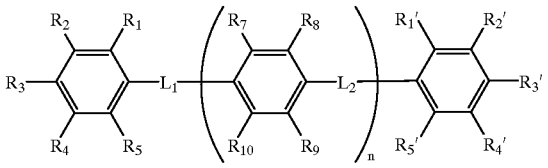

-continued (R-III)

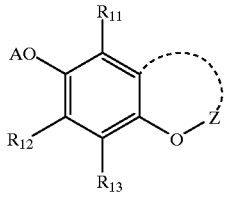

(R-IV)

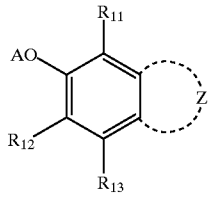

In formula (R-III), Z forms a cyclic structure represented by the following formula (Z-1) or (Z-2).

(Z-1)

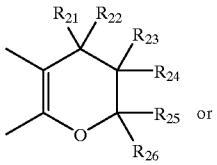

(Z-2)

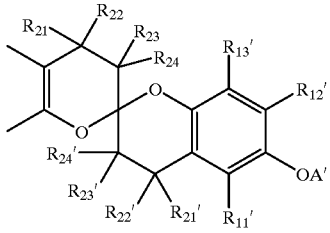

In formula (R-IV), Z forms a cyclic structure represented by the following formula (Z-3) or (Z-4).

(Z-3)

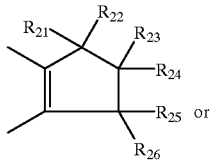

(Z-4)

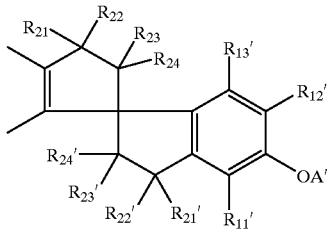

In formulae (R-I) and (R-II), each of $L_1$ and $L_2$ is a group CH—$R_6$ or a sulfur atom, and n is a natural number.

Herein, R is used as a representative of $R_1$ to $R_{10}$, $R_1'$ to $R_5'$, $R_{11}$ to $R_{13}$, $R_{11}'$ to $R_{13}'$, $R_{21}$ to $R_{26}$, and $R_{21}'$ to $R_{24}'$. R is a hydrogen atom, alkyl group having 1 to 30 carbon atoms, aryl group, aralkyl group, halogen atom, amino group or a substituent represented by —O—A, with the proviso that at least one of $R_1$ to $R_5$, at least one of $R_{1'}$ to $R_5'$, and at least one of $R_7$ to $R_{10}$ each are a group represented by —O—A. Alternatively, R groups, taken together, may form a ring. A and A' each are a hydrogen atom, alkyl group having 1 to 30 carbon atoms, acyl group having 1 to 30 carbon atoms, aryl group, phosphate group or sulfonyl group. R, A and A' may be substituted groups while typical examples of the substituent include an alkyl group (including active methine groups), nitro group, alkenyl group, alkynyl group, aryl group, heterocyclic ring-containing group, group containing a quaternized nitrogen atom-containing heterocyclic ring (e.g., pyridinio group), hydroxyl group, alkoxy group (including a group containing recurring ethyleneoxy or propyleneoxy units), aryloxy group, acyloxy group, acyl group, alkoxycarbonyl group, aryloxycarbonyl group, carbamoyl group, urethane group, carboxyl group, imido group, amino group, carbonamide group, sulfonamide group, ureido group, thioureido group, sulfamoylamino group, semicarbazide group, thiosemicarbazide group, hydrazino-containing group, quaternary ammonia-containing group, mercapto group, (alkyl, aryl or heterocyclic) thio group, (alkyl or aryl) sulfonyl group, (alkyl or aryl) sulfinyl group, sulfo group, sulfamoyl group, acylsulfamoyl group, (alkyl or aryl) sulfonylureido group, (alkyl or aryl) sulfonylcarbamoyl group, halogen atom, cyano group, phosphoric acid amide group, phosphate structure-containing group, acylurea structure-bearing group, selenium or tellurium atom-containing group, and tertiary or quaternary sulfonium structure-bearing group. The substituent on R, A and A' may be further substituted, with preferred examples of the further substituent being those groups exemplified as the substituent on R. The further substituent, in turn, may be further substituted, the still further substituent, in turn, may be further substituted, and so on. In this way, multiple substitution is acceptable while preferred substituents are those groups exemplified as the substituent on R, A and A'.

Illustrative, non-limiting, examples of the compounds represented by formulae (R-I), (R-II), (R-III) and (R-IV) are given below.

TABLE 1

| No. | $R_1$, $R_{1'}$ | $R_2$, $R_{2'}$ | $R_3$, $R_{3'}$ | $R_4$, $R_{4'}$ | $R_5$, $R_{5'}$ | $L_1$ | $R_6$ |
|---|---|---|---|---|---|---|---|
| R-I-1 | —OH | —$CH_3$ | —H | —$CH_3$ | —H | CH—R6 | —H |
| R-I-2 | —OH | —$CH_3$ | —H | —$CH_3$ | —H | CH—R6 | —$CH_3$ |
| R-I-3 | —OH | —$CH_3$ | —H | —$CH_3$ | —H | CH—R6 | —$C_3H_7$ |
| R-I-4 | —OH | —$CH_3$ | —H | —$CH_3$ | —H | CH—R6 | —$C_5H_{11}$ |
| R-I-5 | —OH | —$CH_3$ | —H | —$CH_3$ | —H | CH—R6 | -TMB |
| R-I-6 | —OH | —$CH_3$ | —H | —$CH_3$ | —H | CH—R6 | —$C_9H_{19}$ |
| R-I-7 | —OH | —$CH_3$ | —H | —$CH_3$ | —H | S | — |
| R-I-8 | —OH | —$CH_3$ | —H | —$C_2H_5$ | —H | S | — |
| R-I-9 | —OH | —$CH_3$ | —H | —$C_4H_9$(t) | —H | S | — |
| R-I-10 | —OH | —$C_4H_9$(t) | —H | —$CH_3$ | —H | CH—R6 | —H |
| R-I-11 | —OH | —$C_4H_9$(t) | —H | —$CH_3$ | —H | CH—R6 | —$CH_3$ |
| R-I-12 | —OH | —$C_4H_9$(t) | —H | —$CH_3$ | —H | CH—R6 | -TMB |
| R-I-13 | —OH | —$C_4H_9$(t) | —H | —$C_2H_5$ | —H | CH—R6 | —Ph |
| R-I-14 | —OH | —CHex | —H | —$CH_3$ | —H | S | — |
| R-I-15 | —OH | —$C_4H_9$(t) | —H | —$C_2H_5$ | —H | S | — |
| R-I-16 | —OH | —$C_2H_5$ | —H | —$C_4H_9$(t) | —H | CH—R6 | —H |
| R-I-17 | —OH | —$C_2H_5$ | —H | —$C_4H_9$(t) | —H | CH—R6 | —$CH_3$ |
| R-I-18 | —OH | —$C_2H_5$ | —H | —$C_4H_9$(t) | —H | CH—R6 | -TMB |
| R-I-19 | —OH | —$CH_3$ | —H | —$C_4H_9$(t) | —H | CH—R6 | —Ph |
| R-I-20 | —OH | —$CH_3$ | —Cl | —$C_4H_9$(t) | —H | CH—R6 | —H |
| R-I-21 | —OH | —$CH_3$ | —H | —$C_4H_9$(t) | —OCH3 | CH—R6 | —H |
| R-I-22 | —H | —$C_4H_9$(t) | —OH | —CPen | —H | CH—R6 | —H |
| R-I-23 | —H | —$C_4H_9$(t) | —OH | —$C_4H_9$(t) | —H | CH—R6 | -TMB |
| R-I-24 | —H | —$C_4H_9$(t) | —OH | —H | —H | CH—R6 | —H |
| R-I-25 | —H | —$C_4H_9$(t) | —OH | —H | —H | CH—R6 | —$C_3H_7$ |
| R-I-26 | —H | —$CH_3$ | —OH | —$C_4H_9$(t) | —H | CH—R6 | -TMB |
| R-I-27 | —H | —$C_2H_5$ | —OH | —$C_4H_9$(t) | —H | CH—R6 | —H |
| R-I-28 | —H | —$CH_3$ | —OH | —$C_2H_5$ | —H | CH—R6 | -TMB |
| R-I-29 | —H | —$CH_3$ | —OH | —$CH_3$ | —H | S | — |
| R-I-30 | —H | —$CH_3$ | —OH | —$CH_3$ | —Cl | S | — |
| R-I-31 | —H | —$CH_3$ | —OH | —$C_2H_5$ | —H | S | — |
| R-I-32 | —H | —$C_2H_5$ | —OH | —$C_2H_5$ | —H | S | — |
| R-I-33 | —H | —$C_2H_5$ | —OH | —$CH_3$ | —Cl | S | — |
| R-I-34 | —H | —$CH_3$ | —OH | —$C_4H_9$(t) | —H | S | — |
| R-I-35 | —H | —CHex | —OH | —$C_4H_9$(t) | —H | S | — |

TMB: 1,3,3-trimethylbutyl group
CPen: cyclopentyl group
CHex: cyclohexyl group

TABLE 1-continued

| No. | $R_1$, $R_{1'}$ | $R_2$, $R_{2'}$ | $R_3$, $R_{3'}$ | $R_4$, $R_{4'}$ | $R_5$, $R_{5'}$ | $L_1$ | $R_6$ |
|---|---|---|---|---|---|---|---|

(R-I)

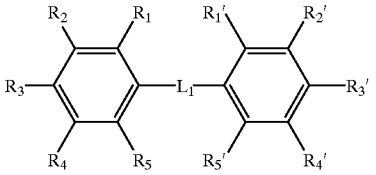

TABLE 2

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-36 | —OH | —$CH_3$ | —H | —$CH_3$ | —H | —H | —$CH_3$ | —OH | —$CH_3$ | —H | CH—R6 | —H |
| R-I-37 | —OH | —$C_4H_9$(t) | —H | —$CH_3$ | —H | —H | —$CH_3$ | —OH | —$CH_3$ | —H | CH—R6 | —H |
| R-I-38 | —OH | —$CH_3$ | —H | —$CH_3$ | —H | —H | —CHex | —OH | —$CH_3$ | —H | CH—R6 | —$CH_3$ |
| R-I-39 | —OH | —$C_4H_9$(t) | —H | —$CH_3$ | —H | —H | —$CH_3$ | —OH | —$CH_3$ | —H | CH—R6 | —$CH_3$ |
| R-I-40 | —OH | —$CH_3$ | —H | —$CH_3$ | —H | —H | —$CH_3$ | —OH | —$CH_3$ | —H | CH—R6 | -TMB |
| R-I-41 | —OH | —$C_4H_9$(t) | —H | —$CH_3$ | —H | —H | —$CH_3$ | —OH | —$CH_3$ | —H | CH—R6 | -TMB |
| R-I-42 | —OH | —$CH_3$ | —H | —$CH_3$ | —H | —H | —$CH_3$ | —OH | —$CH_3$ | —H | S | — |
| R-I-43 | —OH | —$C_4H_9$(t) | —H | —$CH_3$ | —H | —H | —$CH_3$ | —OH | —$CH_3$ | —H | S | — |
| R-I-44 | —OH | —$CH_3$ | —H | —$CH_3$ | —H | —H | —CHex | —OH | —$CH_3$ | —H | S | — |

R-I-45

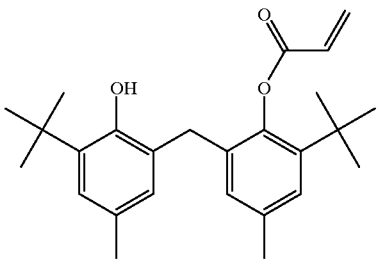

R-I-46

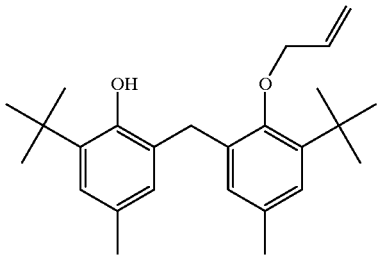

R-I-47

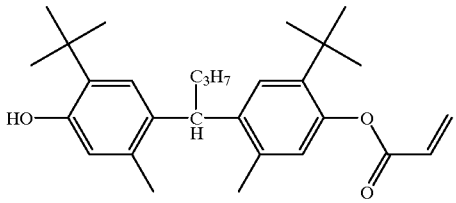

R-I-48

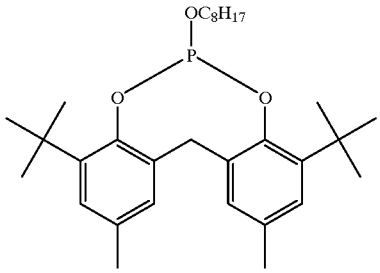

TABLE 2-continued
| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-49 | 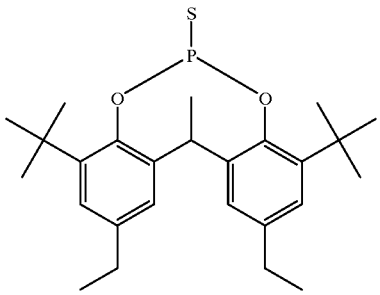 | | | | | | | | | | | |
| R-I-50 | 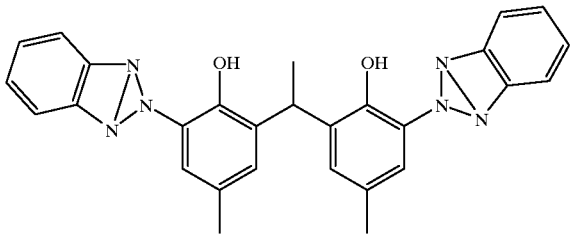 | | | | | | | | | | | |
| R-I-51 | 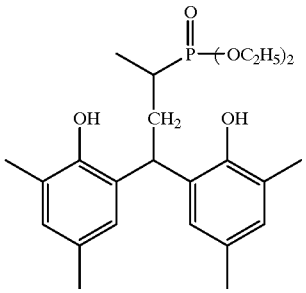 | | | | | | | | | | | |
| R-I-52 | 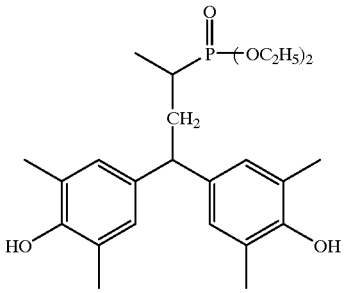 | | | | | | | | | | | |
| R-I-53 | 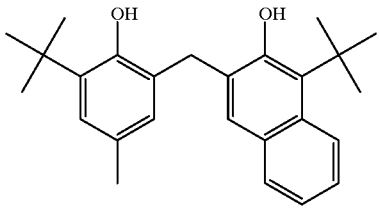 | | | | | | | | | | | |

TABLE 2-continued

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-54 | 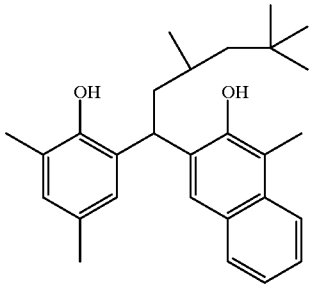 | | | | | | | | | | | |
| R-I-55 | 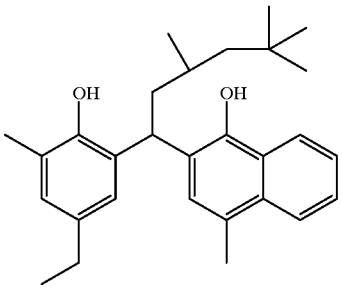 | | | | | | | | | | | |

CHex: cyclohexyl group (R-I) 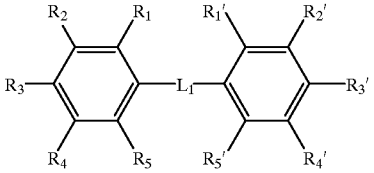

TABLE 3

| No. | $R_1$, $R_{1'}$ | $R_2$, $R_{2'}$ | $R_3$, $R_{3'}$ | $R_4$, $R_{4'}$ | $R_5$, $R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-1 | —OH | —$C_4H_9$(t) | —H | —$CH_3$ | —H | —OH | —$CH_3$ | —$CH_3$ | —H | CH—R6 | —H | CH—R6' | —$CH_3$ | 1 |
| R-II-2 | —OH | —$CH_3$ | —H | —$CH_3$ | —H | —OH | —$C_2H_5$ | —$CH_3$ | —H | CH—R6 | -TMB | CH—R6' | —$CH_3$ | 1 |
| R-II-3 | —OH | —$C_4H_9$(t) | —H | —$CH_3$ | —H | —OH | —$CH_3$ | —$CH_3$ | —H | CH—R6 | —H | CH—R6' | -TMB | 3 |
| R-II-4 | —OH | —$CH_3$ | —H | —$CH_3$ | —H | —OH | —$C_2H_5$ | —$CH_3$ | —H | CH—R6 | -TMB | CH—R6' | -TMB | 2 |
| R-II-5 | —H | —$C_4H_9$(t) | —OH | —$CH_3$ | —H | —OH | —$CH_3$ | —$CH_3$ | —H | S | — | CH—R6' | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |
| R-II-7 | —H | —$C_4H_9$(t) | —OH | —$CH_3$ | —H | —OH | —$CH_3$ | —$CH_3$ | —H | S | — | S | — | 2 |
| R-II-8 | —H | —$CH_3$ | —OH | —$CH_3$ | —H | —OH | —$C_2H_5$ | —$CH_3$ | —H | S | — | CH—R6' | -TMB | 3 |

(R-II) 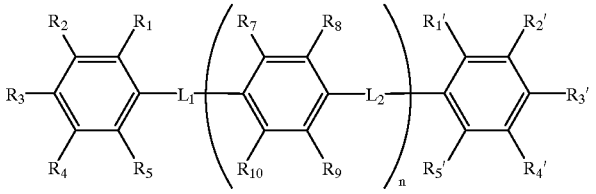

TABLE 4

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_{16}H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{33}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | -DHP | —H |

DHP: 2,4-dihydroxyphenyl group (R-III)

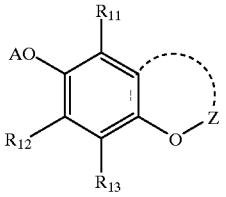

(Z-I)

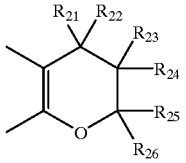

TABLE 5

| No. | Z | $R_{11}$, $R_{11'}$ | $R_{12}$, $R_{12'}$ | $R_{13}$, $R_{13'}$ | $R_{21}$, $R_{22}$ | $R_{21'}$, $R_{22'}$ | $R_{23}$, $R_{24}$ | $R_{23'}$, $R_{24'}$ | A |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

(R-III)

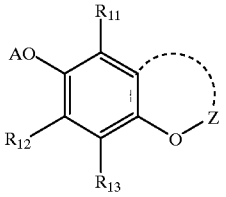

(Z-2)

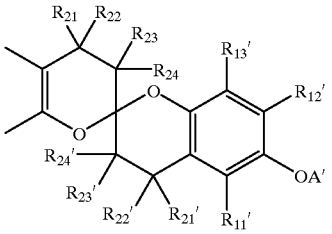

TABLE 6

| No. | Z | $R_{21}$ | $R_{12}$ | $R_{13}$ | $R_{21}$, $R_{22}$ | $R_{23}$, $R_{24}$ | $R_{25}$, $R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —$CH_3$ | —H | —H | —H |

(R-IV)

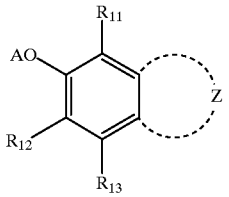

(Z-3)

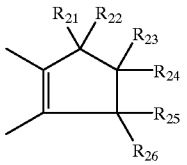

TABLE 7

| No. | Z | $R_{11}$, $R_{11'}$ | $R_{12}$, $R_{12'}$ | $R_{13}$, $R_{13'}$ | $R_{21}$, $R_{21'}$ | $R_{22}$, $R_{22'}$ | $R_{23}$, $R_{24}$ | $R_{23'}$, $R_{24'}$ | A |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_5$ | —$CH_3$ | —H | —H | —H |

(R-IV)

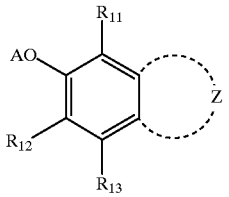

(Z-4)

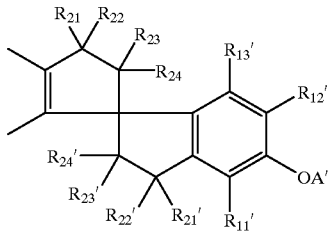

The reducing agent is preferably used in an amount of $1\times10^{-3}$ to 10 mol, more preferably $1\times10^{-2}$ to 1.5 mol per mol of silver.

In the practice of the invention, the reducing agent is used by dispersing or dissolving it in water or a water-miscible organic solvent such as methanol, ethanol, dimethylformamide, and acetonitrile.

A well-known emulsifying dispersion method is used for dissolving the reducing agent with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the reducing agent in powder form in water in a ball mill, colloidal mill or ultrasonic mixer. Also, the reducing agent may be contained in microparticulates of a polymer as described in JP-A 948/1990.

It is especially preferred to add the reducing agent by the solid dispersion method. Although the photosensitive layer having the reducing agent added in an amount of $1\times10^{-2}$ to 10 mol per mol of silver tends to lower its physical strength, such strength lowering is minimized when the reducing agent is added as a solid dispersion. For example, 1 to 50% by weight of the reducing agent is mixed with water with the aid of 1 to 30% by weight of the solids of a surfactant as a dispersant and the resulting water slurry is dispersed by a dispersing machine. It is desired to continue dispersion until a submicron dispersion having a mean particle size of up to 1 $\mu$m is obtained.

As previously mentioned, a thermoplastic resin is used in the photothermographic material of the invention. The resin used herein should be thermoplastic at a drying temperature in order that a coating be formed by applying the resin onto a support and heat drying it. The drying temperature generally ranges from room temperature to about 100° C. Drying is done at a temperature in this range. Examples of the thermoplastic resin used herein include cellulose acetate butyrate, cellulose acetate propionate, styrene-butadiene copolymers, polyvinyl acetal resins (e.g., polyvinyl formal and polyvinyl butyral), polyurethanes, polyvinyl acetate, and acrylic resins (inclusive of acrylic rubber). These polymers have a weight average molecular weight Mw of about 1,000 to about 100,000.

In the practice of the invention, the thermoplastic resin is used in such a range that it may effectively function as a binder. The effective range may be properly determined by those skilled in the art without undue experimentation. Taken at least as a measure for maintaining the organic silver salt in the film, the weight ratio of the binder to the organic silver salt is preferably in the range of from 15:1 to 1:2, more preferably from 8:1 to 1:1.

The non-photosensitive silver salt used herein, which is typically an organic silver salt, is relatively stable to light, but forms a silver image when heated at 80° C. or higher in the presence of an exposed photocatalyst (as typified by a latent image of photosensitive silver halide) and a reducing agent. Preferred are silver salts of long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred heavy metal salt series oxidizing agents include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide materials also applies to the photothermographic material of the present invention. That is, as organic silver salt grains constituting image forming regions of photothermographic material increase in size, the covering power becomes smaller and the image density becomes lower. It is thus necessary to reduce the grain size. In the practice of the invention, grains should preferably have a minor axis of 0.01 μm to 0.20 μm, more preferably 0.01 μm to 0.15 μm and a major axis of 0.10 μm to 5.0 μm, more preferably 0.10 μm to 4.0 μm. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, and determining the autocorrelation function of the fluctuation of scattering light relative to a time change, and obtaining the grain size (volume weighed mean diameter) therefrom.

The organic silver salt may be used in any desired amount, preferably about 0.1 to 5 grams per square meter, more preferably about 1 to 3 grams per square meter of photosensitive material. It is noted that the total coverage of silver is preferably about 0.1 to 5 grams per square meter, more preferably about 0.3 to 3 grams per square meter of photosensitive material.

The organic silver salt used herein is preferably desalted. The desalting method is not critical. Any well-known method may be used although well-known filtration methods such as centrifugation, suction filtration and ultrafiltration are preferred.

In the practice of the invention, the organic silver salt is prepared into a solid microparticulate dispersion using a dispersant in order to provide fine particles of small size and free of flocculation. A solid microparticulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, and roller mills.

The dispersant used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semi-synthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropylmethyl cellulose, as well as naturally occurring high molecular weight compounds such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent growth of bacteria during storage.

In the practice of the invention, a sensitizing dye may be used in the photothermographic material. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. A choice may be advantageously made among sensitizing dyes having spectral sensitivity adequate for spectral characteristics of a light source of various laser imagers, scanners, image setters and lithographic cameras.

Exemplary sensitizing dyes for spectral sensitization to red light may be advantageously selected from compounds I-1 to I-38 described in JP-A 18726/1979, compounds I-1 to I-35 described in JP-A 75322/1994, and compounds I-1 to I-34 described in JP-A 287338/1995 for He—Ne laser light sources; and dyes 1 to 20 described in JP-B 39818/1980, compounds I-1 to I-37 described in JP-A 284343/1987, and compounds I-1 to 1-34 described in JP-A 287338/1995 for LED light sources.

Silver halide grains can be spectrally sensitized in any wavelength region in the range of 750 to 1400 nm. More specifically, photosensitive silver halide can be spectrally advantageously sensitized with various known dyes including cyanine, merocyanine, styryl, hemicyanine, oxonol, hemioxonol and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, UKP 1,466,201, 1,469,117, and 1,422,057, JP-B 10391/1991 and 52387/1994, JP-A 341432/1993, 194781/1994, and 301141/1994. Especially preferred dye structures are cyanine dyes having a thioether bond, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, and Publication of International Patent Application No. 500926/1995.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dyes may be used in admixture of two or more in the practice of the invention. The sensitizing dye is added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969 and 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to a solution.

The time when the sensitizing dye is added to the silver halide emulsion according to the invention is at any step of an emulsion preparing process which has been acknowledged effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

In the photothermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—SM and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazoline rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H) quinazolinone, 7-trifluoromethyl-4-quinoline thiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

Using anti-foggants, stabilizers, and stabilizer precursors, the silver halide emulsion and/or organic silver salt according to the invention may be further protected against generation of additional fog and stabilized against a drop of sensitivity during shelf storage. The anti-foggants, stabilizers, and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazols as described in U.S. Pat. No. 3,287,135, sulfocatechols as described in U.S. Pat. No. 3,235,652, oximes, nitrons, and nitroindazoles as described in UKP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogenated organic compounds as described in U.S. Pat. Nos. 4,108,665, 4,442,202, 3,874,946, and 4,756,999, triazines as described in U.S. Pat. Nos. 4,128,557, 4,137,079, 4,138,365, and 4,459,350, and phosphorus compounds as described in U.S. Pat. No. 4,411,985.

In the photosensitive layer according to the invention, polyhydric alcohols (for example, glycerins and diols of the type described in U.S. Pat. No. 2,960,404), fatty acids and esters thereof as described in U.S. Pat. Nos. 2,588,765 and 3,121,060, and silicone resins as described in UKP 955,061 may be used as a plasticizer and lubricant.

According to the invention, a hardener may be used in various layers including a photosensitive layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

In the practice of the invention, a surfactant may be used for the purposes of improving coating and electric charging properties. The surfactant used herein may be nonionic, anionic or cationic or a fluorinated one. Examples include fluorinated polymer surfactants as described in JP-A 170950/1987 and U.S. Pat. No. 5,382,504, polysiloxane surfactants as described in JP-A 244945/1985 and 188135/1988, and polyalkylene oxide and anionic surfactants as described in JP-A 301140/1994.

It is sometimes advantageous to add a mercury (II) salt to an emulsion layer as an anti-foggant though not necessary in the practice of the invention. Mercury (II) salts preferred to this end are mercury acetate and mercury bromide. The mercury (II) salt is generally used in an amount of 0.75 to 25 mol %, preferably 2 to 20 mol % of the heavy metal salt oxidizing agent.

It is sometimes advantageous to add an additive known as a "toner" for improving images in addition to the aforementioned components. The toner may be present in an amount of 0.1 to 10% by weight of the overall silver holding components. The toner is well known in the photographic art as described in U.S. Pat. Nos. 3,080,254, 3,847,612, and 4,123,282.

Examples of the toner include phthalimide and N-hydroxyphthalimide; cyclic imides such as succinimide, pyrazoline-5-one, quinazoline, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobalt hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)naphthalene-2,3-dicarboxyimide; blocked pyrazoles, isothiuronium derivatives and certain optical fading agents such as N,N'-hexamethylenebis(1-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl) phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(l-naphthyl) phthlazine, 6-chlorophthalazine, 5,7-dimethoxyphthalazine and 2,3-dihydrophthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione; and 6-nitro-1,3-benzoxazine-2,4-dione; pyrimidine and asymtriazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-(o-chlorophenyl)-3,6-dimercapto-1H,4H-2,3a,5,6a-tetraazapentalene.

In the present invention, hydrazine compounds may be used for the purposes of enhancing contrast and promoting development. The hydrazine compounds used herein include compounds of the general formula (I) described in Japanese Patent Application No. 47961/1994, specifically compounds I-1 to I-53 described therein.

Hydrazine derivatives are also preferred. Exemplary hydrazine derivatives include the compounds of the chemical formula [1] in JP-B 77138/1994, more specifically the compounds of the general formula (1) described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39,and 40 of the same; and the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (1) in JP-A 5610/1995, more specifically compounds. I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group forming an intramolecular hydrogen bond with the hydrogen atom of hydrazine described in Japanese Patent Application No. 191007/1995, specifically the compounds of the general formulae (A), (B), (C), (D), (E), and (F), more specifically compounds N-1 to N-30 described therein; and the compounds of the general formula (1) in Japanese Patent Application No. 191007/1995, more specifically compounds D-1 to D-55 described therein.

Hydrazine compounds are used by dissolving in suitable water-miscible organic solvents such as alcohols (e.g., methanol, ethanol, propanol, and fluorinated alcohols), ketones (e.g., aetone and methyl ethyl ketone), dimethylformamide, dimethylsulfoxide, and methyl cellosolve.

A well-known emulsifying dispersion method is used for dissolving the hydrazine derivative with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine compound used herein may be added to any layer on the same side as the silver halide emulsion layer on a support, that is, the silver halide emulsion layer or protective layer, preferably to the silver halide emulsion layer.

The hydrazine compound is preferably used in an amount of 1 μmol to 10 mmol, more preferably 10 μmol to 5 mmol, most preferably 20 μmol to 5 mmol per mol of the organic silver salt.

Components necessary to constitute the photosensitive material such as reducing agent, toner and antifoggant may be added by any desired method although they are preferably added in the form of a solid microparticulate dispersion using a dispersant as described in conjunction with the organic silver salt. Solid fine particles can be formed by the same methods as used for the preparation of a solid microparticulate dispersion of the organic silver salt. The solid microparticulate dispersion should preferably have a mean particle size of 0.005 to 10 μm, more preferably 0.01 to 3 μm, most preferably 0.05 to 0.5 μm.

A surface protective layer may be provided in the photosensitive material according to the present invention for the purpose of preventing adhesion of an image forming layer. The surface protective layer may be formed of any adhesion-preventing material. Examples of the adhesion-preventing material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699. The filter dyes are preferably used in such amounts as to provide an absorbance of 0.1 to 3, more preferably 0.2 to 1.5 at the exposure wavelength.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion surface may have any degree of matte insofar as no star dust failures occur although a Bekk smoothness of 1,000 to 10,000 seconds, especially 2,000 to 10,000 seconds is preferred.

The photothermographic material of the present invention is preferably a one side photosensitive material having at least one photosensitive layer containing a silver halide emulsion (that is, emulsion layer) on one surface of a support and a backing layer (or back layer) on the other surface.

In the present invention, a matte agent may be added to the one side photosensitive material for improving transportation. The matte agent used herein is generally a microparticulate water-insoluble organic or inorganic compound. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide (silica), titanium dioxide, magnesium dioxide, aluminum oxide, barium sulfate, calcium carbonate, silver chloride and silver bromide desensitized by a well-known method, glass, and diatomaceous earth. The matte agent used herein is preferably fine particles of polystyrene, polymethyl methacrylate, and silica. The aforementioned matte agents may be used as a mixture of substances of different types if necessary. The size and shape of the matte agent are not critical although spherical fine particles are preferred. The matte agent of any particle size may be used although it is preferred to use matter agents having a particle size of 0.1 μm to 30 μm, more preferably 0.2 μm to 20 μm, most preferably 0.5 μm to 10 μm. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the backing layer should preferably have a degree of matte as expressed by a Bekk smoothness of 10 to 250 seconds, more preferably 50 to 180 seconds.

In the photosensitive material of the invention, the matte agent is preferably contained in an outermost surface layer, a layer functioning as an outermost surface layer, a layer close to the outer surface or a layer functioning as a so-called protective layer.

The amount of matte agent added varies with the layer construction and thickness of the photothermographic material and the purpose of addition although a coverage of about 10 to 200 mg/m$^2$, especially about 20 to 100 mg/m$^2$ is preferred.

In the practice of the invention, the binder used in the backing layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methy methacrylate), polyvinyl chloride, poly(methacrylic acid), copoly(styrene-maleic anhydride), copoly(styrene-acrylonitrile), copoly(styrene-butadiene), poly(vinyl acetals) (e.g., poly(vinyl formal) and poly(vinyl butyral)), polyesters, polyurethanes, phenoxy resins, poly(vinylidene chloride), polyepoxides, polycarbonates, poly(vinyl acetate), cellulose esters, and polyamides. The binder may be dispersed in water to form a dispersion which is coated to form a layer.

In the practice of the invention, the backing layer preferably has a maximum absorbance of 0.3 to 2 in a desired wavelength range, more preferably an IR absorbance of 0.5 to 2 and an absorbance of 0.001 to less than 0.5 in the visible range. Most preferably it is an anti-halation layer having an optical density of 0.001 to less than 0.3.

Where anti-halation dyes are used in the practice of the invention, such a dye may be any compound which has sufficiently low absorption in the visible region and provides the backing layer with a preferred absorbance spectrum profile. Exemplary anti-halation dyes are the compounds described in JP-A 13295/1995, U.S. Pat. No. 5,380,635, JP-A 68539/1990, page 13, lower-left column to page 14, lower-left column, and JP-A 24539/1991, page 14, lower-left column to page 16, lower-right column though not limited thereto.

A backside resistive heating layer as described in U.S. Pat. Nos. 4,460,681 and 4,374,921 may be used in a photothermographic imaging system according to the present invention.

According to the invention, the photothermographic emulsion may be coated on various supports. Typical supports include polyester film, undercoated polyester film, poly(ethylene terephthalate) film, polyethylene naphthalate film, cellulose nitrate film, cellulose ester film, poly(vinyl acetal) film, polycarbonate film and associated or resinous materials, as well as glass, paper and metals. Often used are flexible substrates, typically paper supports, specifically baryta paper and paper supports coated with partially acetylated α-olefin polymers, especially polymers of α-olefins having 2 to 10 carbon atoms such as polyethylene, polypropylene, and ethylene-butene copolymers. The support may be either transparent or opaque, preferably transparent.

The photosensitive material of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, the photothermographic emulsion can be coated by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and UKP 837,095.

According to the invention, the organic silver salt and silver halide are dispersed in an aqueous dispersion of a thermoplastic resin and the aforementioned various compounds such as reducing agents which are optionally contained in the photosensitive layer (emulsion layer) are added thereto to form an aqueous coating solution, which is applied to the support.

In general, a surface protective layer is formed on the photosensitive layer. The photosensitive layer can be coated concurrent with the protective layer although they may be coated separately. The backing layer (or back layer) may also be formed by coating.

It is noted that the reducing agent can be added to the surface protective layer as by dissolving it in an organic solvent. It is preferred to add the reducing agent to the photosensitive layer. In this preferred embodiment, a water dispersion of the reducing agent prepared by a solid dispersion method is preferably added to the aqueous coating solution for forming the photosensitive layer.

After layers are formed by coating, they are heat dried. Heat drying is done at a temperature of 30 to 100° C. for about 30 seconds to 10 minutes.

In the photothermographic material of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate photosensitive material.

The photosensitive material of the invention may be developed by any process although it is generally exposed imagewise and then developed by heating. The developing temperature is preferably 80 to 250° C., more preferably 100 to 140° C. The developing time is preferably 1 to 180 seconds, more preferably 10 to 90 seconds.

The photosensitive material of the invention may be exposed by any method although laser light is the preferred exposure light source. Laser light is preferably available from gas lasers, YAG lasers, dye lasers, and semiconductor lasers. A semiconductor laser combined with a second harmonic generating device may also be used.

In the most preferred embodiment, a styrene-butadiene copolymer is used as the binder. The "styrene-butadiene copolymer" used herein is a copolymer containing styrene and butadiene in its molecular chain. The molar ratio of styrene to butadiene is preferably from 50:50 to 95:5, more preferably from 60:40 to 90:10.

The styrene-butadiene copolymer used herein may have another monomer copolymerized with styrene and butadiene. Examples of the other monomer include esters of acrylic acid and methacrylic acid such as methyl methacrylate and ethyl methacrylate, acids such as acrylic acid, methacrylic acid, and itaconic acid, and other vinyl monomers such as acrylonitrile and divinyl benzene. Such ternary or more copolymers should preferably have a styrene-butadiene content of 50 to 99% by weight, more preferably 60 to 97% by weight.

Preferably the styrene-butadiene copolymer has a number average molecular weight of about 2,000 to 1,000,000, more preferably about 5,000 to 500,000.

The styrene-butadiene copolymer used herein is generally a random copolymer. The copolymer may be a linear, branched or crosslinked. Most often, the copolymer is used in the form of particles having a mean particle size of 0.05 to 0.3 $\mu$m.

Illustrative examples of the styrene-butadiene copolymer used herein are given below.

P-1 latex of —$St_{70}$—$Bu_{30}$— (Mw=30,000)

P-2 latex of —$St_{60}$—$Bu_{37}$—$MAA_3$— (Mw=45,000)

P-3 latex of —$St_{50}$—$Bu_{40}$—$AN_7$—$AA_3$— (Mw=70,000)

P-4 latex of —$St_{70}$—$Bu_{20}$—$DVB_5$—$MAA_5$— (Mw=100,000)

P-5 latex of —$St_{50}$—$Bu_{30}$—$AN_{15}$—$IA_5$— (Mw=60,000)

In the formulae, St is styrene, Bu is butadiene, MAA is methacrylic acid, AA is acrylic acid, AN is acrylonitrile, DVB is divinyl benzene, and IA is itaconic acid.

Commercially available examples of the styrene-butadiene copolymer used herein are Nipol Lx410, 430, 435, 416, and 2507 by Nihon Zeon K.K., DL-670, L-5702 and 1235 by Asahi Chemicals K.K., Lacstar 3307B, DS203, 7132C and DS807 by Dai-Nihon Ink Chemical K.K.

In the present invention, the "photosensitive layer" of the photothermographic material is a layer containing silver halide. In this context, the organic silver salt (non-photosensitive silver salt) and reducing agent need not be contained in the photosensitive layer.

According to the invention, at least one photosensitive layer should contain the above-mentioned styrene-butadiene copolymer as a binder. Either a single styrene-butadiene copolymer or a mixture of styrene-butadiene copolymers may be used. In the photosensitive layer, the coverage of styrene-butadiene copolymer is preferably 1.0 to 40 g/m$^2$, more preferably 3.0 to 30 g/m$^2$. In the photosensitive layer, the styrene-butadiene copolymer preferably occupies at least 50% by weight, more preferably at least 70% by weight of the binder. It is, of course, acceptable that the binder consists of the styrene-butadiene copolymer. The remainder of the binder, if any, is preferably gelatin, polyvinyl alcohol or a cellulose derivative such as methyl cellulose, hydroxypropyl cellulose, and hydroxypropylmethyl cellulose.

In one preferred process, the photosensitive layer is formed by preparing a coating solution of essential and optional components in a solvent, applying the coating solution, and drying the coating. In the coating solution, water constitutes at least 30% by weight, preferably at least 50% by weight, more preferably at least 70% by weight of the solvent. The remainder of the solvent, if any, is a water-miscible organic solvent such as methyl alcohol, ethyl alcohol, isopropyl alcohol, ethyl acetate, dimethylformamide, methyl cellosolve, ethyl cellosolve, and butyl cellosolve. Exemplary solvent mixtures are a mixture of water/methyl alcohol in a weight ratio of 90/10, 70/30 or 50/50, a mixture of water/isopropyl alcohol in a weight ratio of 90/10, a mixture of water/dimethylformamide in a weight ratio of 95/5, and a mixture of water/methyl alcohol/dimethylformamide in a weight ratio of 90/5/5 or 80/15/5. Using such a solvent, the coating solution for the photosensitive layer is preferably adjusted to a solids concentration of 0.5 to 12% by weight, more preferably 1 to 8%.

While the photosensitive layer contains the silver halide and the binder, other components including a non-photosensitive silver salt, reducing agent therefor, toner, hydrazine derivative, dye, filler, surfactant and crosslinking agent may also be added if necessary.

If desired, the photosensitive material is provided with non-photosensitive layers including a surface protective layer, intermediate layer, and anti-halation layer. The non-photosensitive layers may be formed by coating a coating solution in an organic solvent or by coating a coating solution in an aqueous solvent as used in forming the photosensitive layer, with the latter being preferred. The binder used in non-photosensitive layers may be gelatin, polyvinyl alcohol or polymer latex as described for the first embodiment. The non-photosensitive layers may contain a non-photosensitive silver salt, reducing agent therefor, matte agent, lubricant, toner, surfactant, filler, and crosslinking agent if necessary.

No particular limit is imposed on the coating method used for forming the photosensitive and non-photosensitive layers. Any well-known method such as bar coating and dip coating may be used. A preferred procedure for coating a plurality of layers is by coating a photosensitive layer and coating a non-photosensitive layer prior to drying. It is especially preferred to simultaneously coat photosensitive and non-photosensitive layers using a slide hopper capable of simultaneous coating of multiple layers.

No particular limit is imposed on the method of drying the photosensitive and non-photosensitive layers. Usually such layers are dried at a temperature of about 30 to 300° C. for about ½ to 30 minutes although the exact temperature and time vary depending on a particular type of photosensitive material. It is especially preferred to simultaneously dry the photosensitive and non-photosensitive layers, in the above-mentioned range of temperature and time. Simultaneous drying of photosensitive and non-photosensitive layers ensures better surface quality. If necessary, the photosensitive and non-photosensitive layers are kept at a temperature of about 0° C. to 20° C. for about 5 seconds to about 10 minutes before drying.

EXAMPLE

Examples of the present invention are given below by ay of illustration and not by way of limitation.

Example 1

(1) Preparation of Sample Nos. 102–120

Preparation of Silver Halide Grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing 9 $\mu$mol/liter of dipotassium hexachloroiridate and 1 mol/liter of potassium bromide were added over 30 minutes by a controlled double jet method while maintaining the solution at pAg 7.7. The solution was then desalted by lowering its pH to cause flocculation and sedimentation. Phenoxyethanol, 0.1 gram, was added to the solution, which was adjusted to pH 5.9 and pAg 8.2. There were obtained silver iodobromide grains in the form of cubic grains having an iodine content of 8 mol % in the core and 2 mol % on the average, a mean grain size of 0.05 μm, a coefficient of variation of projected area of 8%, and a (100) plane ratio of 79%.

The thus obtained silver halide grains were heated at 60° C., to which 85 μmol of sodium thiosulfate, 11 μmol of 2,3,4,5,6-pentafluorophenyldiphenylphosphine selenide, 15 μmol of tellurium compound (1) shown below, 3.4 μmol of chloroauric acid, and 260 μmol of thiocyanic acid were added per mol of silver. The solution was ripened for 120 minutes and quenched to 30° C., obtaining silver halide grains.

tellurium compound (1)

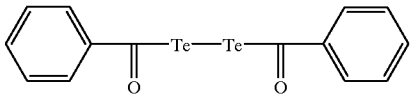

Preparation of Organic Acid Silver Salt Emulsion

A mixture of 1.3 grams of stearic acid, 0.5 gram of arachidonic acid, 8.5 grams of behenic acid, and 300 ml of distilled water was stirred at 90° C. for 15 minutes. With vigorous stirring, 31.1 ml of 1N NaOH aqueous solution was added over 15 minutes to the solution, which was cooled to 30° C. Then 7 ml of 1N phosphoric acid aqueous solution was added to the solution, and with more vigorous stirring, 0.02 gram of N-bromosuccinimide was added to the solution and the above-prepared silver halide grains were added in such an amount as to give 2.5 mmol of silver halide. Further, 25 ml of 1N silver nitrate aqueous solution was added over 2 minutes and stirring was continued for 90 minutes. The solids were separated by suction filtration and washed with water until the water filtrate reached a conductivity of 30 μS/cm.

Subsequent vacuum drying yielded solids of silver halide/organic acid silver salt. To 10 grams of the solids was added 40 grams of a 10 wt % aqueous solution of hydroxypropyl cellulose. Further 0.1 mmol of pyridinium bromide perbromide and 0.15 mol of calcium bromide dihydrate were added. The mixture was dispersed by means of a homogenizer, obtaining a water dispersion of silver halide/organic acid silver salt having a mean particle size of about 1 μm, designated Dispersion (1).

Preparation of Photosensitive Layer Coating Solution

A water dispersion of components was prepared by mixing 250 grams of a 10 wt % aqueous solution of hydroxypropyl cellulose with 10 mg of phenylthiosulfonic acid, 60 mg of dye (1), 30 mg of dye (2), 2 grams of 2-mercapto-5-methylbenzimidazole, 21.5 grams of 4-chlorobenzophenone-2-carboxylic acid, 8 grams of 5-tribromomethylsulfonyl-2-methylthiadiazole, 6 grams of 2-tribromomethylsulfonylbenzothiazole, 150 grams of 1,1-bis(2-hydroxy-3,5-dimethylphenyl)-3,5,5-trimethylhexane, 5 grams of 4,6-ditrichloromethyl-2-phenyltriazine, 2 grams of disulfide compound (1), and 5 grams of tetrachlorophthalic acid, and dispersing the mixture by means of a homogenizer.

This dispersion, 10.3 grams, was admixed with 50 grams of Dispersion (1). Further, 10 grams of a binder (the type of which is shown in Table 8) and 3 mg of sodium p-dodecylbenzenesulfonate were added to the mixture. Distilled water was added to the dispersion, obtaining 200 ml of a coating solution.

The additives used herein are shown below.

dye (1)

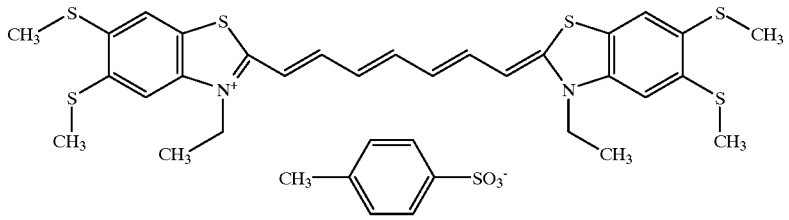

dye (2)

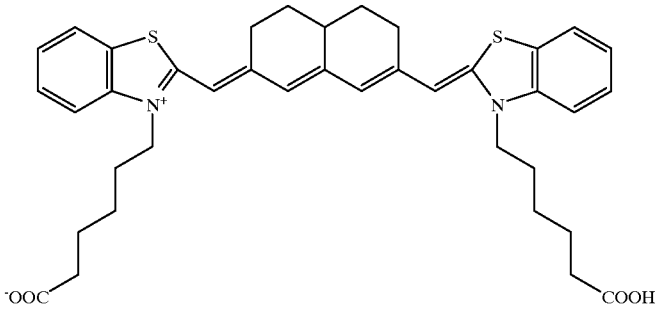

-continued

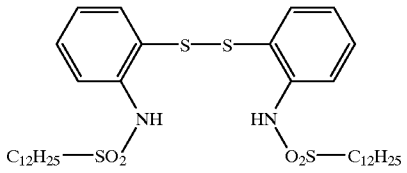

disulfide compound (1)

Preparation of Surface Protective Layer Coating Solution

| | |
|---|---|
| Lime-treated gelatin | 4 g |
| Phthalazine (5 wt % solution in water/methanol = 1/1 weight ratio) | 480 mg |
| Sodium 4-methylphthalate (4% in water) | 240 mg |
| Polymethyl methacrylate fine particles (mean particle size 5 μm) | 80 mg |
| $C_7F_{15}COONa$ | 20 mg |
| Sodium p-dodecylbenzenesulfonate | 20 mg |

A coating solution was prepared by adding distilled water to a final volume of 100 ml.

Preparation of Sample

On one surface of a biaxially oriented polyethylene terephthalate support of 175 μm thick, a back surface coating solution was coated so as to provide a binder coverage of 1.5 g/m$^2$ and dried at 50° C. for 20 minutes. A back layer having a dry thickness of 1.5 μm was formed.

Then the photosensitive layer coating solution was coated on the opposite surface of the support so as to provide a silver coverage of 2.3 g/m$^2$ and dried at 50° C. for 20 minutes, forming a photosensitive layer having a dry thickness of 20 μm.

The surface protective layer coating solution was coated on the photosensitive layer so as to provide a binder coverage of 2 g/m$^2$ and dried at 50° C. for 20 minutes, forming a protective layer having a dry thickness of 1.6 μm. In this way, sample Nos. 102 to 120 were prepared.

(2) Preparation of Sample No. 101

Sample No. 101 was prepared by the same procedure as sample Nos. 102 to 120 except that the composition of the photosensitive layer was changed as shown below, that is, the photosensitive layer was coated with the aid of an organic solvent.

Preparation of Organic Acid Silver Salt Emulsion

To 10 grams of the solids of silver halide/organic acid silver salt prepared in the procedure of sample Nos. 102 to 120 were added 4 grams of polyvinyl butyral (Denka Butyral #3000K, Denki Kagaku Kogyo K.K.) and 36 grams of 2-butanone.

Further 0.1 mmol of pyridinium bromide perbromide and 0.15 mol of calcium bromide dihydrate were added. The mixture was dispersed by means of a homogenizer, obtaining a water dispersion of silver halide/organic acid silver salt having a mean particle size of about 1 μm, designated Dispersion (2).

Preparation of Photosensitive Layer Coating Solution

A solution (1) was prepared by dissolving 10 mg of phenylthiosulfonic acid, 60 mg of dye (1), 30 mg of dye (2), 2 grams of 2-mercapto-5-methylbenzimidazole, 21.5 grams of 4-chlorobenzophenone-2-carboxylic acid, 8 grams of 5-tribromomethylsulfonyl-2-methylthiadiazole, 6 grams of 2-tribromomethylsulfonylbenzothiazole, 150 grams of 1,1-bis (2-hydroxy-3,5-dimethyl-phenyl)-3,5,5-trimethylhexane, 5 grams of 4,6-ditrichloromethyl-2-phenyltriazine, 2 grams of disulfide compound (1), and 5 grams of in 445 grams of 2-butanone, and further adding 5 grams of polyvinyl butyral (Denka Butyral #3000K).

Preparation of Back Layer Coating Solution

| | |
|---|---|
| Binder (polyvinyl alcohol) | 15 g |
| Distilled water | 1000 g |
| Sodium p-dodecylbenzenesulfonate | 30 mg |
| Dinacole EX313 (epoxy compound, Nagase Chemicals K.K.) | 100 mg |
| Dyestuff (a) | 50 mg |
| Dyestuff (b) | 110 mg |
| Dyestuff (c) | 40 mg |
| Dyestuff (d) | 50 mg |
| Polymethyl methacrylate fine particles (mean particle size 5 μm) | 20 mg |

The dyestuffs used herein are shown below.

dyestuff (a)

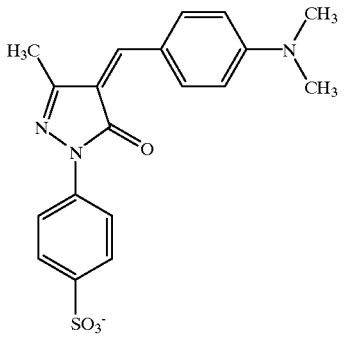

-continued dyestuff (b)

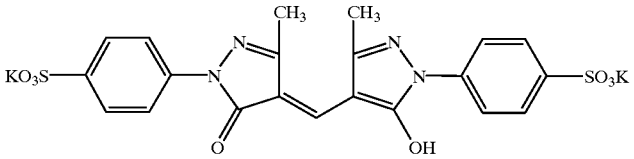

dyestuff (c)

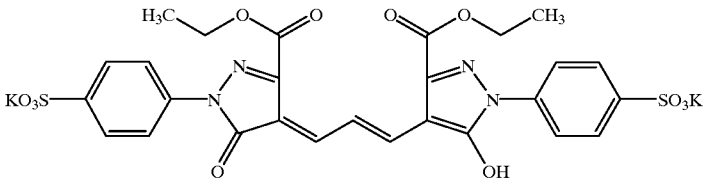

dyestuff (d)

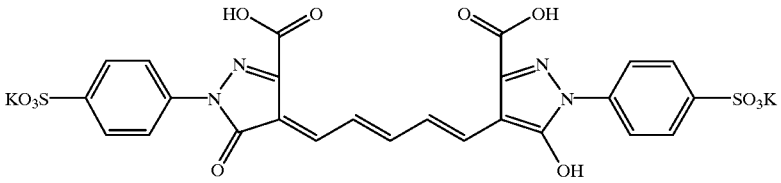

A coating solution was prepared by mixing 11.1 grams of a solution of the above-mentioned composition with 50 grams of Dispersion (2), adding 10 grams of polyvinyl butyral (Butvar B-76, Monsanto Co.) and 3 mg of Megafax F176P (Dai-Nihon Ink Chemical Industry K.K.), and adding 2-butanone to a final volume of 200 ml.

For sample Nos. 101 to 120, the binder used in the photosensitive layer was measured for moisture content and photographic properties were examined.

Moisture Content of Binder

A solution or dispersion of the polymer used in the photosensitive layer was applied onto a glass plate and dried at 50° C. for one hour, forming a model polymer film of about 100 μm thick. Where a mixture of two or more polymers was used as the binder in the photosensitive layer, a model film of a polymer mixture having the same mix ratio was formed. The model polymer film was peeled from the glass plate and conditioned in an atmosphere of 25° C. and RH 60% for 3 days whereupon its weight (W1) was measured. Then the model polymer film was kept in vacuum at 25° C. for 3 days and immediately placed in a weighing bottle having a known weight (W2) whereupon the total weight (W3) was measured. The dry weight (W0) of the model polymer film was calculated as the total weight of the model polymer film and the bottle minus the weight of the bottle (W0=W3−W2). A moisture content is given by the following expression using W0 and W1.

Equilibrium moisture content at 25° C. and RH 60%= (W1−W0)/W0×100%

Evaluation of Photographic Properties

A photosensitive material was exposed by means of a laser sensitometer equipped with a 810-nm diode in an atmosphere of 25° C. and RH 60% and heated for development at 120° C. for 25 seconds to form an image. The image was examined for sensitivity, fog and maximum density (Dmax) by means of a densitometer. The sensitivity is evaluated in terms of an inversion of a ratio of an exposure dose providing a density higher than the fog or minimum density (Dmin) by 0.3 and expressed by a relative value based on coated sample No. 101. It is noted that the laser beam was directed to the surface of the photosensitive material at an angle of 80°.

This measurement was done after the photosensitive material was kept in an atmosphere of 25° C. and RH 60% for 24 hours (normal humidity photographic properties).

Measurement was similarly done in an atmosphere of 25° C. and RH 80% after the photosensitive material was kept in an atmosphere of 25° C. and RH 80% for 24 hours (high humidity photographic properties).

The results are shown in Table 8.

TABLE 8

| Sample | Binder in Photosensitive | Moisture Content | Coataing | Normal humidity photographic properties | | | High humidity photographic properties | | |
|---|---|---|---|---|---|---|---|---|---|
| No. | layer | (wt %) | Solvent | Fog | Sensitivity | Dmax | Fog | Sensitivity | Dmax |
| 101 (s.c.) | PVB | 1.2 | 2-Butanone* | 0.23 | 100 | 3.1 | 0.31 | 100 | 2.9 |
| 102 (comp) | Gelatin | 10.5* | Water | 0.25 | 103 | 3.2 | 0.56 | 95 | 2.7 |
| 103 (comp) | PVA | 3.2* | Water | 0.28 | 110 | 3.4 | 0.52 | 80 | 2.7 |
| 104 | P-1 | 0.6 | Water | 0.24 | 100 | 3.0 | 0.30 | 105 | 2.9 |
| 105 | P-2 | 0.4 | Water | 0.22 | 95 | 3.1 | 0.28 | 100 | 3.0 |
| 106 | P-3 | 0.3 | Water | 0.22 | 100 | 3.1 | 0.26 | 110 | 2.9 |
| 107 | P-4 | 0.5 | Water | 0.23 | 100 | 3.1 | 0.29 | 105 | 2.8 |
| 108 | P-5 | 0.3 | Water | 0.22 | 95 | 3.2 | 0.31 | 100 | 2.9 |
| 109 | P-6 | 0.3 | Water | 0.24 | 95 | 3.1 | 0.30 | 105 | 2.9 |
| 110 | FINETEX ES611 | 0.8 | Water | 0.23 | 100 | 3.1 | 0.28 | 100 | 2.9 |
| 111 | Hydran AP40 | 0.8 | Water | 0.24 | 100 | 3.0 | 0.29 | 95 | 3.0 |

TABLE 8-continued

| Sample No. | Binder in Photosensitive layer | Moisture Content (wt %) | Coataing Solvent | Normal humidity photographic properties Fog | Sensitivity | Dmax | High humidity photographic properties Fog | Sensitivity | Dmax |
|---|---|---|---|---|---|---|---|---|---|
| 112 | Hydran HW350 | 0.7 | Water | 0.22 | 100 | 3.0 | 0.32 | 100 | 2.9 |
| 113 | Chemipearl S120 | 0.2 | Water | 0.25 | 105 | 3.1 | 0.29 | 100 | 2.9 |
| 114 | P-1/gelatin = 80/20 | 1.6 | Water | 0.25 | 100 | 3.2 | 0.33 | 105 | 2.7 |
| 115 | FINETEX611/Gelatin = 80/20 | 1.4 | Water | 0.24 | 100 | 3.0 | 0.32 | 110 | 2.8 |
| 116 | P-1 | 0.6 | Water/methanol = 70/30 | 0.24 | 100 | 3.1 | 0.29 | 100 | 2.9 |
| 117 | FINETEX 611 | 0.8 | Water/methanol = 70/30 | 0.25 | 105 | 3.2 | 0.31 | 100 | 2.9 |
| 118 (comp) | P-1/gelatin = 60/40 | 6.5* | Water | 0.24 | 100 | 3.2 | 0.52 | 105 | 2.8 |
| 119 (comp) | P-1 | 0.6 | Water/methanol = 20/80* coating solution flocculated | | | | | | |
| 120 | P-1 | 0.6 | Water/methanol = 40/60 | 0.22 | 100 | 3.1 | 0.31 | 105 | 2.9 |

*outside the scope of the invention
s.o. means solvent coating.
Comp means comparison.

It is evident from Table 8 that fog increase in a humid atmosphere is suppressed by using a polymer within the scope of the invention as a primary component of the binder in the photosensitive layer. Possible coating with the aid of water solvent is favorable from the standpoints of environment and cost. In contrast, fog increases when the moisture content of a polymer exceeds 2% by weight. When the content of water in the coating solvent is less than 30% by weight, the coating solution becomes less stable and induces flocculation, resulting in a coating having surface defects. The use of an organic solvent as the coating solvent gives rise to no problem with respect to photographic properties, but is disadvantageous from the standpoints of environment and cost.

Example 2

Preparation of Silver Halide Grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing 6 μmol/liter of dipotassium hexachloroiridate and 1 mol/liter of potassium bromide were added over 30 minutes by a controlled double jet method while maintaining the solution at pAg 7.7. The pH of the solution was lowered to cause flocculation and sedimentation for desalting. Phenoxyethanol, 0.1 gram, was added to the solution, which was adjusted to pH 5.9 and pAg 8.2. There were obtained silver iodobromide grains in the form of cubic grains having an iodine content of 8 mol % in the core and 2 mol % on the average, a mean grain size of 0.05 μm, a coefficient of variation of projected area of 8%, and a (100) plane ratio of 92%.

The thus obtained silver halide grains were heated at 60° C., to which 85 μmol of sodium thiosulfate, 11 μmol of 2,3,4,5,6-pentafluorophenyldiphenylphosphine selenide, 15 μmol of tellurium compound (1-a) shown below, 3 μmol of chloroauric acid, and 240 μmol of thiocyanic acid were added per mol of silver. The solution was ripened for 120 minutes and quenched to 30° C., obtaining a silver halide emulsion.

tellurium compound (1-a)

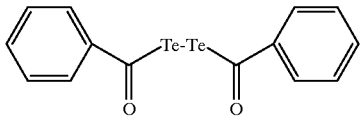

Preparation of Photosensitive Emulsion A Containing Organic Acid Silver Salt Emulsion A mixture of 1.3 grams of stearic acid, 0.5 gram of arachidonic acid, 8.5 grams of behenic acid, and 300 ml of distilled water was stirred at 90° C. for 15 minutes. With vigorous stirring, 31.1 ml of 1N NaOH aqueous solution was added to the solution, which was cooled to 30° C. after 15 minutes. 7 ml of 1N phosphoric acid aqueous solution was added to the solution, and with more vigorous stirring, 0.075 gram of N-bromosuccinimide was added to the solution and the above-prepared silver halide emulsion was added in such an amount as to give 2.5 mmol of silver halide. Further, 25 ml of 1N silver nitrate aqueous solution was added over 2 minutes and stirring was continued for 90 minutes. The solids were separated by suction filtration and washed with water until the water filtrate reached a conductivity of 30 μS/cm.

The aqueous dispersion was passed through a filter to remove excess salts. To the resulting wet dispersion, an aqueous dispersion of polyvinyl butyral, Butvar Dispersion FP (Monsanto Co.), was added in such an amount as to provide 5 grams of polyvinyl butyral per gram of silver behenate. The mixture was dispersed again by a ultrasonic dispersing machine. The polyvinyl butyral in the aqueous dispersion had a mean particle size of 0.3 μm.

Preparation of Coated Sample

The following layers were coated on a polyethylene terephthalate support of 175 μm thick tinted with the following blue dye (1-i).

blue dye (1-i)

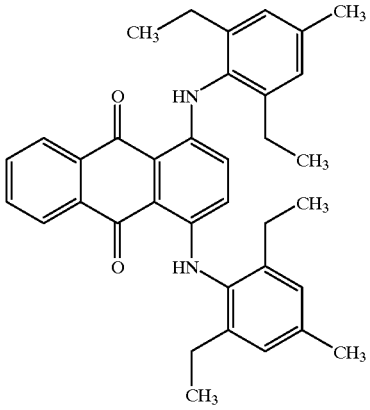

Coating on the Back Surface Side

An aqueous coating solution of the following composition was coated so as to give a coverage of 5 g/m$^2$ of polyvinyl alcohol.

| | |
|---|---|
| Polyvinyl alcohol (PVA205, Kurare K.K.) | 6.0 g |
| Water | 100 ml |
| Boric acid | 0.2 g |
| Mixture of dyes (1-f), (1-g) and (1-h) in a weight ratio of 25:65:1 | 0.2 g |
| Silica particles (mean particle size 5 $\mu$m) | 0.3 g |

The compounds used herein are as shown below.

dye (1-f)

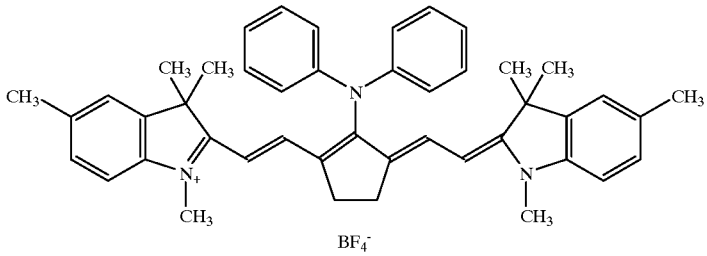

dye (1-g)

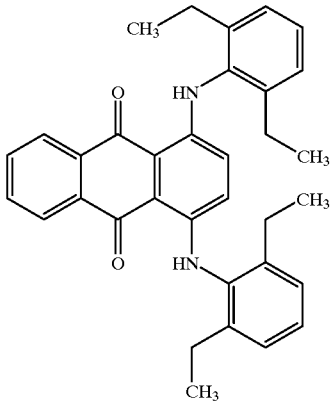

dye (1-h)

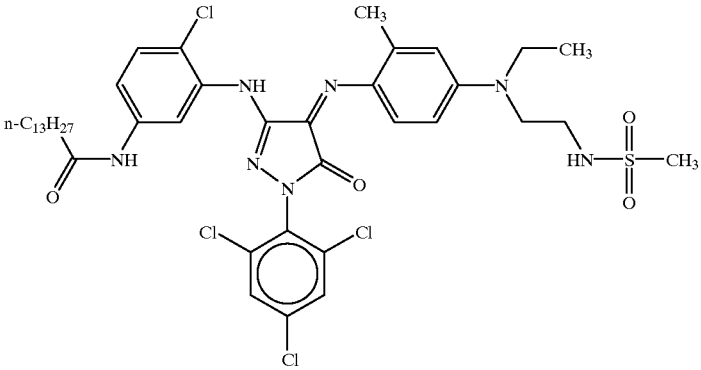

Coating on the Photosensitive Layer Side

A photosensitive layer and a surface protective layer were concurrently coated in an overlapping manner.

The photosensitive layer was formed by coating an aqueous coating solution of the following composition so as to give a coverage of 2.3 g/m$^2$ of silver.

| | |
|---|---|
| Photosensitive emulsion A | 73 g |
| Sensitizing dye (1-b) (0.05% in methanol) | 2 ml |

-continued

| | |
|---|---|
| Sensitizing dye (1-c) (0.05% in methanol) | 1 ml |
| Antifoggant-1 (0.01% in methanol) | 3 ml |
| Antifoggant-2 (1.5% in methanol) | 8 ml |
| Antifoggant-3 (2.4% in DMF) | 5 ml |
| Dispersion of phthalazine and developing agent-1 in water (solids 28 wt %) | 10 g |

The compounds used herein are as shown below.

dye (1-b)

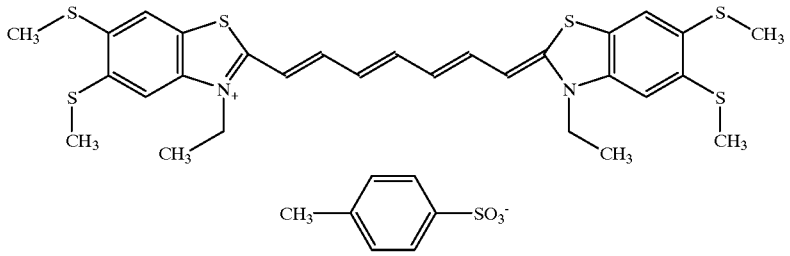

dye (1-c)

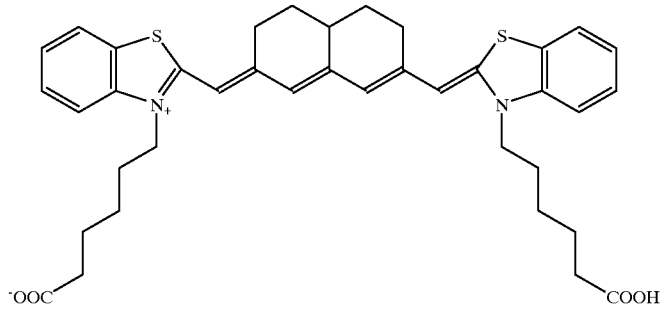

antifoggant-1

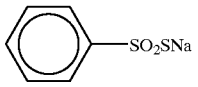

antifoggant-2

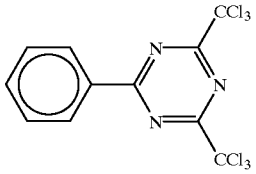

antifoggant-3

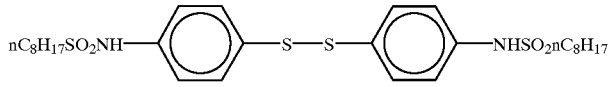

-continued

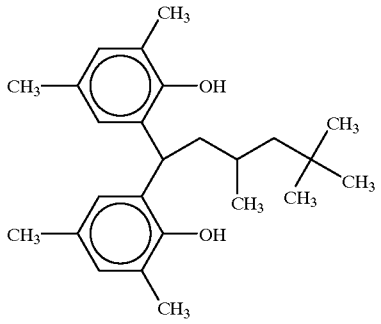

developing agent-1

The dispersion of phthalazine and developing agent-1 in water was prepared by adding 4.6 grams of a dispersant Demol SN-B (trade name, Kao Corporation) to 5.0 grams of phthalazine and 18 grams of developing agent-1, adding 72 ml of water thereto, and agitating the mixture in a sand mill with glass beads as a medium. The dispersion had a mean particle size of 0.3 μm.

The surface protective layer was formed by coating a solution of the following composition to a wet coating thickness of 100 μm.

| | |
|---|---|
| Water | 190 ml |
| Silica (mean particle size 3.0 μm) | 0.2 g |
| Polyvinyl alcohol (PVA205, Kurare K.K.) | 8.0 g |
| 4-methylphthalic acid | 0.72 g |
| Tetrachlorophthalic acid | 0.8 g |
| Sodium dodecylbenzenesulfonate | 2.0 g |

The coatings applied as above were dried at 60° C. for 2 minutes, obtaining a photothermographic material.

Evaluation of Photographic Properties by Sensitometry

A photographic material was exposed by means of a laser sensitometer equipped with a 820-nm diode and heated for development at 120° C. for 15 seconds on a heating drum to form an image, which was examined by means of a densitometer. There was obtained a black image having a minimum density (Dmin) of 0.18 and a maximum density (Dmax) of 2.5.

Example 3

Example 2 was repeated except that 10 ml of 5% methyl ethyl ketone solution of phthalazine and 18 ml of 10% methyl ethyl ketone solution of developing agent-1 were added instead of 10 grams of the water dispersion of phthalazine and developing agent-1. However, the photosensitive emulsion flocculated and sedimented during agitation.

Then, a coated sample was prepared by adding the methyl ethyl ketone solutions of phthalazine and developing agent-1 to the surface protective layer in an equivalent coverage per unit area to Example 2 rather than adding to the photosensitive layer. There was obtained a black image having a Dmin of 0.18 and a Dmax of 1.2 when measured by sensitometry as in Example 2.

Example 4

Example 2 was repeated except that the surface protective layer and the back layer were replaced by layers of the following compositions.

| | |
|---|---|
| Surface protective layer | |
| EVAL F | 8 g |
| $H_2O$ | 90 ml |
| n-propanol | 100 ml |
| Silica (mean particle size 3.0 μm) | 0.2 g |
| 4-methylphthalic acid | 0.72 g |
| Tetrachlorophthalic acid | 0.8 g |
| Back layer | |
| EVAL F | 6.0 g |
| $H_2O$ | 50 ml |
| n-propanol | 50 ml |
| Dye S-1 | 0.05 g |

Note that EVAL F is a trade name of polyvinyl alcohol-olyethylene copolymer by Kurare K.K. and dye S-1 is a compound of the following formula.

dye S-1

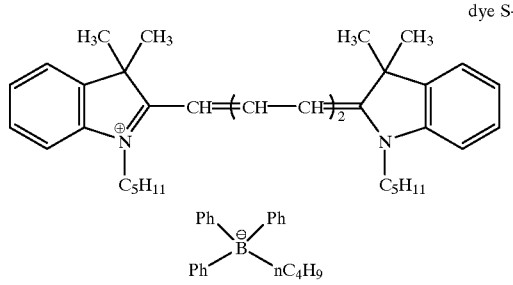

There was obtained a black image having a Dmin of 0.17 and a Dmax of 2.4 when measured by sensitometry as in Example 2.

Example 5

Preparation of Aqueous Dispersion of Polyvinyl Butyral

A mixture of the following components was heated at 60° C. and agitated for 10 minutes in a homogenizer.

| | |
|---|---|
| Polyvinyl butyral (Butvar B76, Monsanto Co.) | 600 g |
| Sodium dodecylbenzenesulfonate | 50 g |
| Butyl ricinoleate | 30 g |
| $H_2O$ | 200 ml |

Then 100 ml of water was added to the mixture, which was agitated for a further 20 minutes. 1.0 liter of water was further added to the mixture, which was agitated for a further 10 minutes, yielding a dispersion having a mean particle size of 0.5 μm.

Preparation and Evaluation of Photosensitive Material

A photosensitive material was prepared and evaluated as in Example 2 except that the above-prepared water dispersion was used instead of Butvar Dispersion FP. The results were equivalent to Example 2.

Example 6

A photosensitive material was prepared and evaluated as in Example 2 except that Adeka Bon-Tighter HUX-350 (Asahi Denka Kogyo K.K.) was used instead of Butvar Dispersion FP. There was obtained a black image having a Dmin of 0.20 and a Dmax of 2.1.

Example 7

A photosensitive material was prepared and evaluated as in Example 2 except that JSR #1500 (Japan Synthetic Rubber K.K.) was used in an equivalent solids amount instead of Butvar Dispersion FP. There was obtained satisfactory results equivalent to Example 2.

Example 8

A photosensitive material was prepared and evaluated as in Example 7 except that a mixture of JSR #1500 and JSR 0051 in a solid weight ratio of 40/60 was used instead of JSR #1500. There was obtained satisfactory results equivalent to Example 7. The image layer had sufficiently high physical strength to be resistant to mar.

Example 9

A photosensitive material was prepared and evaluated as in Example 2 except that acrylic rubber Nipol AR31 (Nippon Zeon K.K.) was used instead of Butvar Dispersion FP. There was obtained satisfactory results equivalent to Example 2.

As previously mentioned, prior art photothermographic material using organic solvents as coating aids suffer from the problems of (1) environmental pollution by evaporation of the organic solvent, (2) low productivity because of low coating rate and difficult concurrent coating of multiple layers and (3) hazard including flammability and explosion. An attempt to design a photothermographic material of a water medium system using a water-soluble binder failed to provide satisfactory photographic performance. In contrast, the present invention is successful in providing a photothermographic material exhibiting satisfactory photographic performance by dispersing an organic silver salt and a silver halide in an aqueous dispersion of a thermoplastic resin and coating the resulting dispersion onto a support, that is, eliminating a need for organic solvent.

Example 10

Preparation of Silver Halide Grains B

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by a controlled double jet method while maintaining the solution at pAg 7.7. The pH of the solution was lowered to cause flocculation and sedimentation for desalting. Phenoxyethanol, 0.1 gram, was added to the solution, which was adjusted to pH 5.9 and pAg 8.0. There were obtained silver iodobromide grains B in the form of cubic grains having an iodine content of 8 mol % in the core and 2 mol % on the average, a mean grain size of 0.07 μm, a coefficient of variation of projected area diameter of 8%, and a (100) plane ratio of 86%.

The thus obtained silver halide grains B was agitated at 35° for 1 hour after potassium iodide was added thereto in an amount of 1 mol % based on the silver. The temperature was then raised to 60° C. With stirring, $5\times10^{-4}$ mol of sensitizing dye A and $2\times10^{-4}$ mol of sensitizing dye B were added per mol of the silver halide. Thereafter, 85 μmol of sodium thiosulfate, 11 μmol of 2,3,4,5,6-pentafluorophenyldiphenylsulfin selenide, 2 μmol of tellurium compound (1-a) (see Example 2), 3.3 μmol of chloroauric acid, and 230 μmol of thiocyanic acid were added per mol of silver. The solution was ripened for 120 minutes and quenched to 30° C., completing the preparation of an emulsion of silver halide grains B.

sensitizing dye A

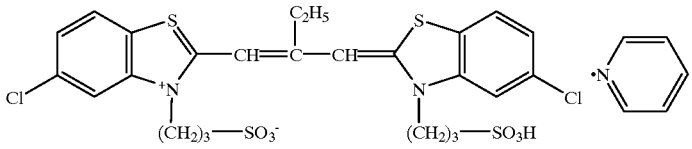

sensitizing dye B

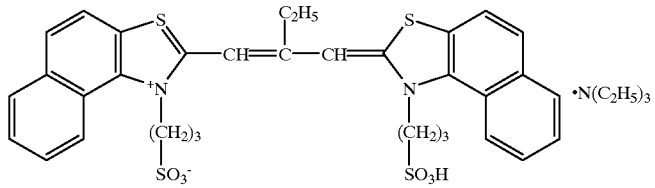

Preparation of a Solid Particle Dispersion of Organic Acid Silver Salt

A mixture of 40 grams of behenic acid, 7.3 grams of stearic acid, and 500 ml of distilled water was stirred at 90° C. for 15 minutes. 187 ml of 1N NaOH aqueous solution was added to the solution over 15 minutes and 61 ml of 1N nitric acid aqueous solution was added to the solution, which was cooled to 50° C. Next, 124 ml of 1N silver nitrate aqueous solution was added to the solution over 2 minutes, and agitation was continued for a further 30 minutes. The solids were separated by suction filtration and washed with water until the water filtrate reached a conductivity of 30 μS/cm. The thus collected solids were handled as wet cake without drying. To an amount of the wet cake corresponding to 34.8 grams of dry solids, 12 grams of polyvinyl alcohol and 150 ml of water were added. A slurry was obtained by thorough agitation. The slurry was admitted into a vessel together with 840 grams of zirconia beads having a mean diameter of 0.5 mm. Dispersion was done for 5 hours by means of a dispersing machine (1/4G sand grinder mill by Imex K.K.), completing the preparation of a solid particle dispersion of organic acid silver salt in the form of needle grains having a mean minor diameter of 0.04 μm, a mean major diameter of 0.8 μm and a coefficient of variation of projected area of 30% as observed under an electron microscope.

Polymer Latex

| | |
|---|---|
| Binder (see Table 9) | 430 g |
| Tetrachlorophthalic acid | 5 g |
| 1,1-bis(2-hydroxy-3,5-dimethylphenyl)-3,5,5-trimethylhexane | 98 g |
| Phthalazine | 9.2 g |
| Tribromomethylphenylsulfone | 12 g |
| 4-methylphthalic acid | 7 g |

TABLE 9

| Example | Photosensitive layer binder | Photographic properties at normal humidity | | | Photographic properties at high humidity | | | Tone |
|---|---|---|---|---|---|---|---|---|
| | | Fog | Dmax | Sensitivity | Fog | Dmax | Sensitivity | |
| 201 * | Lime-treated gelatin | 0.33 | 3.0 | 100 | 0.44 | 2.8 | 100 | X |
| 202 * | PVA 205 | 0.25 | 3.0 | 105 | 0.44 | 2.7 | 110 | X |
| 203 | Boncoat 2830 | 0.16 | 2.9 | 100 | 0.28 | 2.9 | 110 | Δ |
| 204 | Bondic 1320NS | 0.15 | 3.1 | 110 | 0.26 | 2.8 | 110 | X |
| 205 | P-1 | 0.16 | 3.0 | 100 | 0.26 | 2.9 | 105 | ○ |
| 206 | P-2 | 0.15 | 3.0 | 110 | 0.25 | 2.9 | 110 | ○ |
| 207 | P-3 | 0.15 | 3.1 | 100 | 0.25 | 2.7 | 105 | ○ |
| 208 | P-4 | 0.16 | 3.0 | 110 | 0.27 | 2.9 | 110 | ○ |
| 209 | P-5 | 0.16 | 3.1 | 110 | 0.25 | 2.7 | 110 | ○ |
| 210 | Nipol Lx430 | 0.18 | 3.1 | 110 | 0.27 | 2.8 | 105 | ○ |
| 211 | Nipol Lx416 | 0.16 | 3.1 | 105 | 0.25 | 2.8 | 110 | ○ |
| 212 | Lacstar 3307B | 0.15 | 3.1 | 110 | 0.26 | 2.8 | 105 | ○ |
| 213 | Lacstar 3307B B/PVA205 = 85/15 | 0.18 | 3.0 | 110 | 0.31 | 2.9 | 105 | ○ |

* Comparison
Boncoat 2830: polyvinyl acetate latex by Dai-Nihon Ink Chemical K. K.
Bondic 1320NS: water dispersion of polyurethane by Dai-Nihon Ink Chemical K. K.
Nipol Lx430: SBR latex by Nihon Zeon K. K.
Nipol Lx416: SBR latex by Nihon Zeon K. K.
Lacstar 3307B: SBR latex by Dai-Nihon Ink Chemical K. K.
PVA205: polyvinyl alcohol by Kurare K. K.

Preparation of a Solid Microparticulate Dispersion of Each Component

For each of tetrachlorophthalic acid, 4-methylphthalic acid, 1,1-bis(2-hydroxy-3,5-dimethylphenyl)-3,5,5-trimethylhexane, phthalazine, and tribromomethylphenylsulfone, a solid microparticulate dispersion was prepared. To tetrachlorophthalic acid were added 0.81 gram of hydroxypropylmethyl cellulose and 94.2 cc of water. A slurry was obtained by thorough agitation and allowed to stand for 10 hours. Thereafter, the slurry was admitted into a vessel together with 100 cc of zirconia beads having a mean diameter of 0.5 mm. Dispersion was done for S hours by means of the same dispersing machine as used in the preparation of a solid particle dispersion of silver organic acid salt, obtaining a solid microparticulate dispersion of tetrachlorophthalic acid. A 70 wt % fraction had a particle diameter of up to 1.0 μm. For each of the remaining components, a solid microparticulate dispersion was obtained by properly changing the amount of dispersant used and the dispersing time so as to provide a desired mean particle diameter.

Preparation of Emulsion Layer Coating Solution

An emulsion coating solution was prepared by adding silver halide grains B (in an amount corresponding to 10 mol % of silver halide based on the organic acid silver salt), a polymer latex as shown below, and the above-mentioned components to the above-prepared solid particle dispersion of organic acid silver salt (in an amount corresponding to 1 mol of silver). Note that the polymer latex had a mean particle size of about 0.1 μm.

Preparation of Emulsion Surface Protective Layer Coating Solution

A coating solution for a surface protective layer was prepared by adding 0.26 gram of surfactant A, 0.09 gram of surfactant B, 0.9 gram of finely divided silica (mean particle size 2.5 μm), 0.3 gram of 1,2-(bisvinylsulfonylacetamide) ethane, and 64 grams of water to 10 grams of inert gelatin.

surfactant A

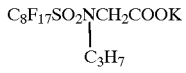

surfactant B

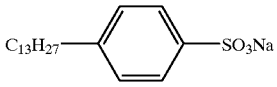

Preparation of Coupler Dispersion

With stirring, 2.5 grams of compound 1 and 7.5 grams of compound 2, both shown below, were dissolved in 35 grams of ethyl acetate. To the solution was added 50 grams of a 10 wt % solution of polyvinyl alcohol (PVA 205 by Kurare K.K.). The mixture was agitated for 5 minutes by a homogenizer. Thereafter, the solvent ethyl acetate was volatilized off. By finally diluting with water, there was obtained a coupler dispersion.

compound 1

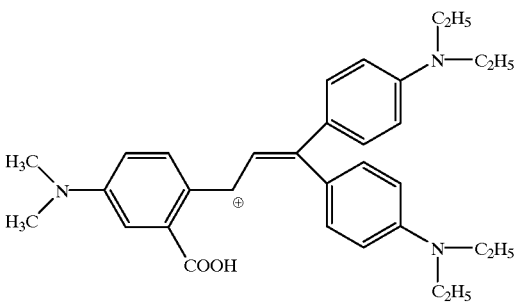

compound 2

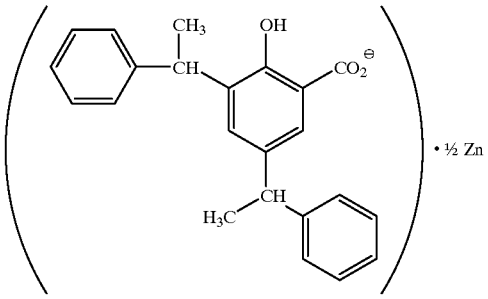

Preparation of Back Surface Coating Solution

A back surface coating solution was prepared by adding 50 grams of the above-prepared coupler dispersion, 20 grams of the compound shown below, 250 grams of water, and 1.8 grams of Sildex H121 (spherical silica by Dokai Chemical K.K., mean particle size 12 μm) to 30 grams of polyvinyl alcohol (PVA 205 by Kurare K.K.).

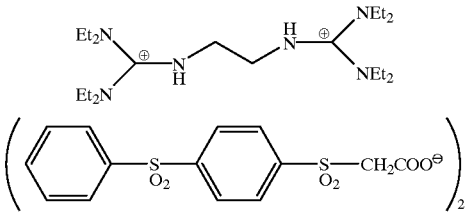

Preparation of Sample

On one surface of a biaxially oriented polyethylene terephthalate support of 175 μm thick tinted with a blue dye, the back surface coating solution was coated so as to provide a binder coverage of 1.5 g/m$^2$ of the binder using a slide hopper. The coating was maintained in an atmosphere of 15° C. and RH 60% for one minute and dried at 40° C. for 20 minutes. Then a photosensitive layer was coated on the opposite surface and dried at 40° C. for 20 minutes. A surface protective layer was further coated thereon, maintained in an atmosphere of 15° C. and RH 60% for 2 minutes, and dried at 40° C. for 20 minutes. With respect to the coverage of each layer, the photosensitive layer was coated so as to provide a silver coverage of 2.2 g/m$^2$ and a binder coverage of about 9 g/m$^2$ and the surface protective layer was coated so as to provide a binder coverage of 2 g/m$^2$. In each case, the coating rate was 10 m/min.

The samples were stored for 10 days in an atmosphere of 25° C. and RH 60% before the following tests were carried out.

Photographic Test

Photographic Properties at Normal Humidity

A sample was moisture conditioned at 25° C. and RH 60% for 24 hours, exposed to light by means of a laser sensitometer equipped with a 810-nm diode, and heated for development at 125° C. for 25 seconds. Note that heat treatment was done by pressing the sample to a stainless steel roller having a diameter of 10 cm. Upon exposure, the angle between the sample surface and laser light was 80°. Exposure and development were carried out in an atmosphere of 25° C. and RH 60%. The resulting image was measured for optical density by means of a densitometer, determining a maximum density (Dmax), minimum density (Dmin=fog), and sensitivity. An exposure dose providing an optical density higher by 0.3 than Dmin was determined, and the sensitivity was expressed by the inverse of a ratio of the exposure dose of each sample to the exposure dose of sample No. 101.

Photographic Properties at High Humidity

Moisture conditioning, exposure and development were carried out in an atmosphere of 25° C. and RH 80% before similar measurement was done.

Color Tone Test

A maximum density area of the sample used for testing photographic properties at normal humidity was visually observed for color tone. The sample was rated "O" (good) for black, "Δ" (fair) for brownish black, and "X" (poor) for brown color. Only samples rated "O" are practically acceptable.

The results are shown in Table 9. As is evident from Table 9, photosensitive materials within the scope of the invention show good photographic properties, especially low fog, at any humidity condition ranging from normal to high humidity and their tone is satisfactory.

Example 11

Example 10 was repeated except that the photosensitive layer and the surface protective layer were concurrently coated and dried. With respect to photographic properties and tone, the results were equivalent to Example 10.

It is noted that sample Nos. 205 to 213 of Example 10 showed slight disorder on the surface whereas samples of Example 11 were free of such disorder and better than those of Example 10 in this respect.

According to the invention, a photosensitive layer can be coated without a need for organic solvents which are harmful to the human body and expensive. Fog is suppressed even when a photothermographic material is stored in a humid atmosphere.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A method for preparing a photothermographic material comprising a support layer and a photosensitive layer on at least one surface of the support layer containing a photosensitive silver halide, an organic silver salt, and a reducing agent therefor, said method comprising the steps of:

dispersing the organic silver salt and the silver halide in an aqueous dispersion of a thermoplastic resin serving as a binder, adding the reducing agent to the aqueous dispersion to form an aqueous coating solution, coating the aqueous coating solution onto a support, and drying the coating solution to form the photosensitive layer.

2. The method of claim 1, further comprising the steps of coating at least one non-photosensitive layer on said photosensitive layer, and concurrently drying said photosensitive layer and said non-photosensitive layer.

3. The method of claim 1, wherein said thermoplastic resin serving as a binder is used in an amount to give a weight ratio of binder to organic silver salt of from 15:1 to 1:2.

4. The method of claim 1, wherein said thermoplastic resin is cellulose acetate butyrate, cellulose acetate propionate, polyvinyl butyral, polyurethane, polyvinyl acetate or styrene-butadiene copolymer.

5. The method of claim 4, wherein said thermoplastic resin is polyvinyl butyral, polyurethane or styrene-butadiene copolymer.

6. The method of claim 4, wherein said thermoplastic resin is a styrene-butadiene copolymer.

7. The method of claim 1, wherein said organic silver salt is a silver salt of a long chain aliphatic carboxylic acid having 10 to 30 carbon atoms.

8. The method according to claim 1, wherein the thermoplastic resin is selected from the group consisting of a polyvinyl butyral, polyurethane, styrene-butadiene copolymer, acryl resin and a mixture thereof.

* * * * *